US007156578B2

(12) United States Patent
Madison

(10) Patent No.: US 7,156,578 B2
(45) **Date of Patent: *Jan. 2, 2007**

(54) AQUIFER RECHARGE VALVE AND METHOD

(76) Inventor: Kent R. Madison, 73700 Highway 207, Echo, OR (US) 97826

( * ) Notice: Subject to any disclaimer, the term of this patent is extended or adjusted under 35 U.S.C. 154(b) by 78 days.

This patent is subject to a terminal disclaimer.

(21) Appl. No.: 10/940,787

(22) Filed: Sep. 13, 2004

(65) Prior Publication Data

US 2005/0039907 A1 Feb. 24, 2005

Related U.S. Application Data

(63) Continuation-in-part of application No. 10/197,055, filed on Jul. 16, 2002, now Pat. No. 6,811,353.

(60) Provisional application No. 60/366,150, filed on Mar. 19, 2002.

(51) Int. Cl.
*E21B 33/03* (2006.01)

(52) U.S. Cl. ..... 405/41; 166/320; 166/334.4

(58) Field of Classification Search ..... 405/36, 405/40, 41, 50, 184.1; 166/50, 51, 278, 320, 166/321, 326, 334.1, 334.4, 332.6; 138/98, 138/99

See application file for complete search history.

(56) References Cited

U.S. PATENT DOCUMENTS

| | | | | |
|---|---|---|---|---|
| 353,548 | A | 11/1886 | Franklin | |
| 922,060 | A | 5/1909 | Stockdon | |
| 966,911 | A | 8/1910 | Hardsocg | |
| 1,285,769 | A | 11/1918 | Melcher | |
| 1,799,373 | A | 4/1931 | Humason | |
| 1,909,179 | A | 5/1933 | Huffman | |
| 1,919,856 | A | 7/1933 | McGeorge | |
| 1,919,955 | A | 7/1933 | Leech et al. | |
| 2,091,482 | A | 8/1937 | McCreary et al. | |
| 2,654,395 | A | 10/1953 | Kaye | |
| 2,664,859 | A | 1/1954 | Green | |
| 2,693,203 | A | 2/1954 | Hempel | |
| 3,112,764 | A | 12/1963 | Anderson et al. | |
| 3,120,267 | A | 2/1964 | Bayless | |
| 3,220,693 | A | 11/1965 | Dickson | |
| 3,379,405 | A | 4/1968 | Natho | |
| 3,497,004 | A | 2/1970 | Page, Jr. | |
| 3,679,169 | A | 7/1972 | Bedo et al. | |
| 3,690,348 | A * | 9/1972 | Patterson | 138/97 |
| 3,735,541 | A | 5/1973 | Vanderlinde | |
| 3,761,053 | A | 9/1973 | Bedo et al. | |
| 3,908,536 | A | 9/1975 | Bajcar | |
| 3,937,247 | A | 2/1976 | Van der Wal | |
| 4,041,982 | A | 8/1977 | Lindner | |
| 4,047,695 | A | 9/1977 | Cleveland et al. | |
| 4,080,982 | A | 3/1978 | Maezawa | |
| 4,114,851 | A | 9/1978 | Shivak et al. | |
| 4,134,454 | A | 1/1979 | Taylor | |

(Continued)

FOREIGN PATENT DOCUMENTS

| | | |
|---|---|---|
| CH | 282823 | 5/1952 |

(Continued)

*Primary Examiner*—John Kreck
(74) *Attorney, Agent, or Firm*—Klarquist Sparkman LLP

(57) ABSTRACT

An aquifer recharge valve assembly comprises a valve movable along the interior of a pipe section to open and close aquifer recharge openings through the pipe section. The position of the valve controls the extent to which the recharge openings are available for delivery of recharge water into the aquifer. The valve may be a seamless resilient cylinder which expands due to well head pressure to assist in sealing the recharge openings when the valve is closed.

31 Claims, 13 Drawing Sheets

U.S. PATENT DOCUMENTS

| | | | | | |
|---|---|---|---|---|---|
| 4,149,698 | A | | 4/1979 | Deaton | |
| 4,154,263 | A | | 5/1979 | Cary | |
| 4,199,272 | A | | 4/1980 | Lacey | |
| 4,248,305 | A | | 2/1981 | Scarbrough et al. | |
| 4,280,569 | A | | 7/1981 | Mount, II | |
| 4,285,495 | A | | 8/1981 | King | |
| 4,330,012 | A | | 5/1982 | Chadwick | |
| 4,375,821 | A | | 3/1983 | Nanao | |
| 4,377,177 | A | | 3/1983 | Claycomb | |
| 4,508,138 | A | | 4/1985 | Dixon | |
| 4,540,022 | A | | 9/1985 | Cove | |
| 4,569,370 | A | | 2/1986 | Witt | |
| 4,582,551 | A | * | 4/1986 | Parkes et al. | 156/94 |
| 4,621,655 | A | | 11/1986 | Roche | |
| 4,691,778 | A | | 9/1987 | Pyne | |
| 4,787,599 | A | | 11/1988 | Nyboer | |
| 4,821,622 | A | | 4/1989 | Burk | |
| 5,014,746 | A | | 5/1991 | Heymann | |
| 5,090,450 | A | | 2/1992 | Pelech et al. | |
| 5,172,717 | A | | 12/1992 | Boyle et al. | |
| 5,176,164 | A | | 1/1993 | Boyle | |
| 5,316,081 | A | | 5/1994 | Baski et al. | |
| 5,511,582 | A | | 4/1996 | Hudson | |
| 5,547,029 | A | | 8/1996 | Rubbo et al. | |
| 5,618,022 | A | | 4/1997 | Wallace | |
| 5,706,861 | A | * | 1/1998 | Wood et al. | 138/98 |
| 5,771,976 | A | | 6/1998 | Talley | |
| 5,853,629 | A | * | 12/1998 | Toyoda et al. | 264/35 |
| 5,871,200 | A | | 2/1999 | Wallace et al. | |
| 5,960,816 | A | | 10/1999 | Mills et al. | |
| 5,971,007 | A | | 10/1999 | Harcourt et al. | |
| 6,073,906 | A | | 6/2000 | Wallace | |
| 6,206,021 | B1 | | 3/2001 | Hartman et al. | |
| 6,286,594 | B1 | | 9/2001 | French | |
| 6,334,486 | B1 | | 1/2002 | Carmody et al. | |
| 6,338,466 | B1 | | 1/2002 | Wallace et al. | |
| 6,811,353 | B1 | * | 11/2004 | Madison | 405/41 |
| 2003/0056951 | A1 | | 3/2003 | Kaszuba | |

FOREIGN PATENT DOCUMENTS

| | | |
|---|---|---|
| EP | 251101 | 1/1988 |
| GB | 952007 | 3/1964 |

* cited by examiner

AQUIFER RECHARGE VALVE AND METHOD

CROSS REFERENCE

This application is a continuation-in-part application of U.S. patent application Ser. No. 10/197,055, filed Jul. 16, 2002, entitled "Aquifer Recharge Valve and Method", invented by Kent R. Madison, now U.S. Pat. No. 6,811,353, which is based on and claims the benefit of U.S. Provisional Patent Application No. 60/366,150, filed on Mar. 19, 2002. The entire disclosure of the provisional application, Ser. No. 60/366,150 and of application Ser. No. 10/197,055, is considered to be part of the disclosure of the following application and is hereby incorporated by reference herein.

BACKGROUND

The present invention relates to a method and apparatus for selectively injecting water into an aquifer to recharge the aquifer, for example during a rainy time of year when water is more available for use in recharging the aquifer.

In many geographic areas, wells are the primary source of water for use in agriculture and for other purposes. In addition, in many areas there is a so-called rainy or wet season where excess water is available. This excess water may be stored in ponds or reservoirs. This excess water may selectively be reintroduced into an aquifer to replenish or recharge the aquifer so that the water stored in the aquifer is then available for pumping from a well during drier times of the year.

In effect, the ground itself is used as a water storage facility.

Various types of recharge valves have been used in the past for delivery of water to an aquifer for recharging the aquifer. However, these known devices suffer from a number of disadvantages. For example, they may be prone to leakage. Consequently, when water is being drawn from the well during a normal pumping operation, some of the water that would otherwise be drawn from the well leaks through the recharge valve.

Therefore, a need exists for an improved aquifer recharge valve assembly and method.

DETAILED DESCRIPTION

The description proceeds with reference to several embodiments. The present invention is directed toward novel and unobvious features and method acts relating to improvements to an aquifer recharge valve and system both alone and in various combinations and subcombinations with one another.

Figure 1:
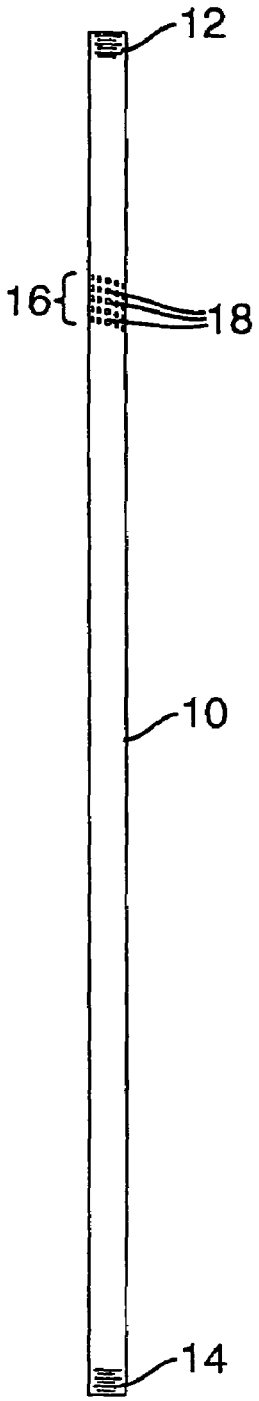
FIG. 1 illustrates an exemplary pipe section provided with a plurality of water recharge orifices.

FIG. 1 shows a pipe section 10 for inclusion in a pump column of a well. For example, pipe section 10 may be a six inch inside diameter steel pipe having threads 12, 14 at its opposite ends for coupling to associated pipe components. The pipe section 10 includes at least one aquifer recharge outlet through which water may pass to recharge an aquifer. However, desirably a plurality of aquifer recharge outlets are provided at spaced locations about the circumference of the pipe section 10. This reduces the aquifer mining that can take place when water passes through an aquifer recharge orifice toward the aquifer, with the mining being more of a problem if only one large orifice is used. As explained in greater detail below, the orifices may be of any suitable shape and pattern. In FIG. 1 the aquifer recharge orifices are arranged in a spiral pattern along a pipe section portion 16 with some of these orifices being indicated at 18 in FIG. 1. The pipe section 10 may be of any suitable length and in FIG. 1 is shown as a twenty foot pipe section. Typically, pipe section 10 ranges from about five feet to about twenty feet, although again this is variable. As another example, the length of an exemplary pipe section in the form of the FIG. 14 embodiment described below is twenty-eight inches.

Figure 2:
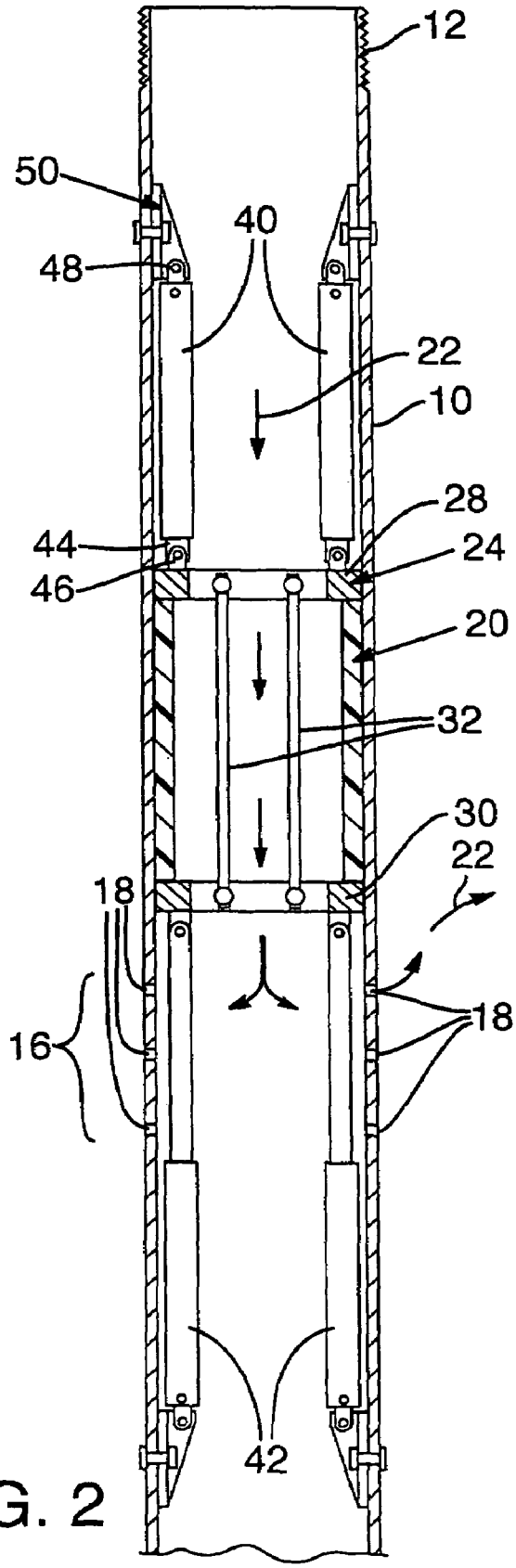
FIG. 2 is a vertical sectional view of a portion of the pipe of FIG. 1 showing an embodiment of an aquifer recharge valve.

FIG. 2 illustrates a vertical sectional view through a portion of pipe section 10 containing an exemplary aquifer recharge valve in accordance with one embodiment.

The illustrated FIG. 2 embodiment comprises a valve 20 positioned within the interior of pipe section 10 and movable between a first position (shown in FIG. 2) in which the valve 20 does not overlie and seal the orifices 18 to a second position in which the valve 20 overlies and closes these orifices. The pipe section 10 is shown in FIG. 2 with the valve 20 above the apertures 18. Other orientations may be used. For example, the pipe section 10 may be inverted from the position shown in FIG. 2. In such a case, the valve 20 would be below the openings 18 and would be shifted upwardly to cover the openings. This inverted orientation is more desirable if the well is to be used a greater extent for recharge applications as the recharge water would not have to flow past valve supporting structures to reach these openings. When open, as shown in FIG. 2, a flow path (indicated schematically by arrows 22) exists through the center of the pipe section 10 and outwardly through the orifices 18. Desirably, the valve 20 comprises a tube having an outside diameter which is sized slightly less than the inside diameter of pipe section 10. For example, if pipe section 10 has an inside diameter of six inches, the outside diameter of valve 20 may be 5 and 15/16 inches. In addition, valve 20 is ideally of a material with some flexibility such that when the valve is positioned to overlie apertures 18, the water pressure within pipe section 10 (the head in the pump column) forces the valve outwardly to provide a good seal of openings 18 against leakage. Because valve 20 is positioned inside pipe section 10, the water pressure in the pipe column assists in maintaining the valve in a closed position as water is being pumped from the well. Valve 20 may be of any suitable material. As a desirable example, valve 20 may be of a polymer material and may be formed, as by machining or otherwise, as a seamless cylinder. In addition, the valve 20 may be nine inches to one foot long. As a specific example, valve 20 may have a one-half inch thick wall and be formed of ultra-high molecular weight polyethylene so that it has some resiliency to assist in accomplishing the seal. This material also slides easily against the interior wall of the pipe section 10. The valve 20 is not limited to this specific material. Other examples of suitable valve materials include: Polyvinyl chloride (PVC); HDPE (high density polyethylene); Nylon (Zytel); or any other semi-rigid or resilient material. Multi-material components may also be used.

The valve 20 may be positioned within a support structure, such as a cage structure. One form of a cage structure is indicated generally at 24. The illustrated cage structure is of a durable material with stainless steel being a specific example. Cage structure 24 comprises upper and lower cross-pieces 28, 30 with the valve 20 retained between the cross-pieces. In the specific form shown, top and bottom pieces 28, 30 comprise annular rings. These rings may, for example, have a one inch height and one inch thickness. The rings when used with a six inch inside diameter pipe section 10 may have an outer diameter of, for example, 5 and 15/16 inches. A plurality of braces, some being indicated at 32, extend longitudinally and may be bolted or otherwise fastened to the respective top and bottom pieces 28, 30. In the illustrated embodiment, four such braces 32 are included and are spaced apart at 90 degree intervals about the rings 28, 30. Braces 32 may comprise, as a specific example, one-quarter inch diameter stainless steel thrust rods. The respective ends of the thrust rods may be inserted into associated holes drilled in the top and bottom pieces 28, 30. The rods may be held in place within such holes by respective set screws extending through the rods from the interior surface of the top and bottom pieces. The top and bottom pieces need not be annular in shape but do permit the passage of water past these pieces.

A drive mechanism is provided for shifting the cage and thus the valve between the open and closed positions. It should be noted that a plurality of open positions are provided depending upon the number of apertures 18 that are exposed. In one specific form, the drive mechanism comprises at least one, and in this case two, valve closing cylinders 40 and at least two valve operating cylinders 42. The cylinders 40, 42 in the illustrated form are single action cylinders, although dual action cylinders may be used as an alternative. With reference to cylinder 40, with the other cylinders being similarly mounted, the piston end 44 of cylinder 40 is pivotally coupled to an ear or mount 46 which projects outwardly from top piece 28. The cylinder housing end 48 of cylinder 40 is pivoted to a mount 50 which is coupled, for example bolted, to the pipe section 10 or to a mount coupled thereto. Extension of cylinders 42 shifts valve 20 upwardly in the FIG. 2 example and exposes the apertures 18 with the number of apertures that are exposed depending upon the extent of the upward shifting of the valve 20. Conversely, extension of cylinders 40 shifts the cage 24 and valve 20 downwardly in the FIG. 2 example. When valve 20 is in a fully closed position, the valve overlies all of the apertures 18. The cylinders 40 and 42 may be operated cooperatively to position the valve 20 at any desired position.

Figure 3:
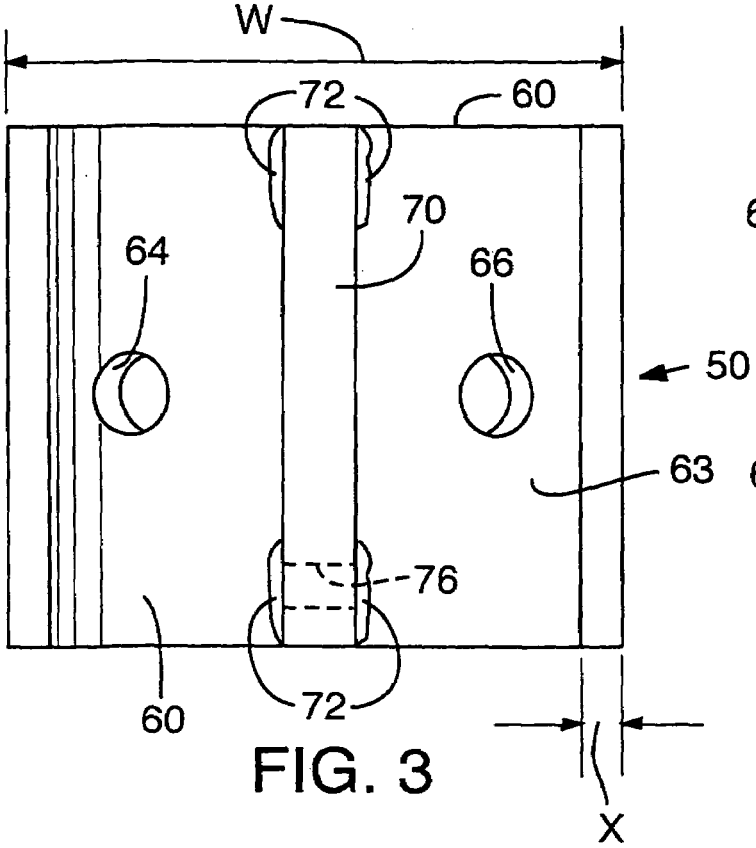
FIG. 3 is a front view of a cylinder mount usable in the recharge valve of FIG. 2.
Figure 5:
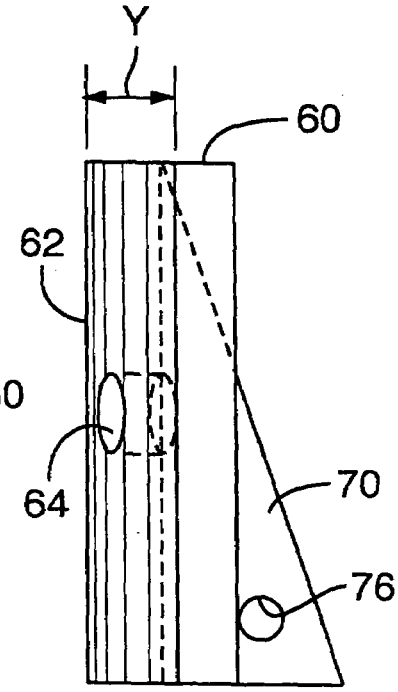
FIG. 5 is a side view of the mount of FIG. 3.
Figure 4:
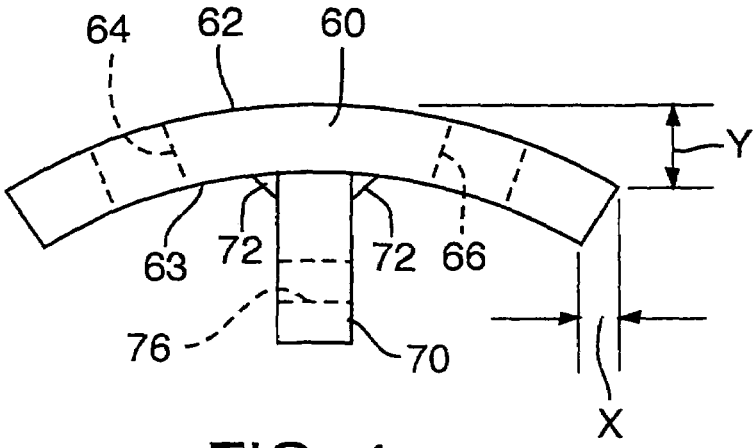
FIG. 4 is a top view of the mount of FIG. 3.

One form of mount 50 is shown in FIGS. 3–5, it being understood that any suitable mounting structure may be used. The structure illustrated in FIGS. 3–5 is mechanically simple and strong. With reference to these figures, mount 50 comprises a curved wall 60 having a back surface 62 which may conform to the curvature of the interior of pipe section 10. The wall 60 also has a concave front surface 63 in this example. First and second fastener receiving openings 64, 66 may be provided at either side of the longitudinal centerline of mount 50. Openings 64, 66 may, for example, be sized to receive 2-½ inch stainless steel fine threaded bolts. The bolts may each be inserted through an associated aperture in pipe section 10 and through one of the respective openings 64, 66. A respective nut, for example, at the interior of the pipe section 10 may be used to secure each of these bolts. Lock washers (not shown) may also be used. As a specific example, mount 50 may be of stainless steel with wall 60 being ⅜ inch in thickness. Although variable, the mount may have a width w of three inches and may be of the same height. The width x indicates that portion of the edge of wall 60 visible in the front view. The dimension y indicates that portion of the rear wall 62 which is visible in the side view shown in FIG. 5. A cylinder mount portion 70 is secured, as by welding the welds 72 to the interior surface 63 of wall 60. The cylinder mount portion 70 may be of any suitable configuration, although in the form shown the portion 70 is depicted as being of a generally triangular shape. Although variable, mount portion 70 may extend the full height of piece 60. Portion 70 may be of a durable material. As a specific example, portion 70 may be one-half inch in thickness and of stainless steel. A fastener receiving opening 76 extends through mount portion 70. The cylinder housing end 48 is fastened, for example by a bolt, extending through a mounting opening in the cylinder housing end and through opening 76 to thereby mount the cylinder in place.

In a typical construction, the cylinders have an eight inch stroke, although this is variable, and may depend in part upon the length of that portion of the pipe section 10 which includes the aquifer recharge apertures. That is, although not required, a desirable construction involves having a sufficient cylinder stroke to move the valve 20 enough of a distance to open all of the aquifer recharge apertures when the valve is shifted to its full open position and to close all of the aquifer recharge apertures when the valve is shifted to its fully closed position.

Figure 6:
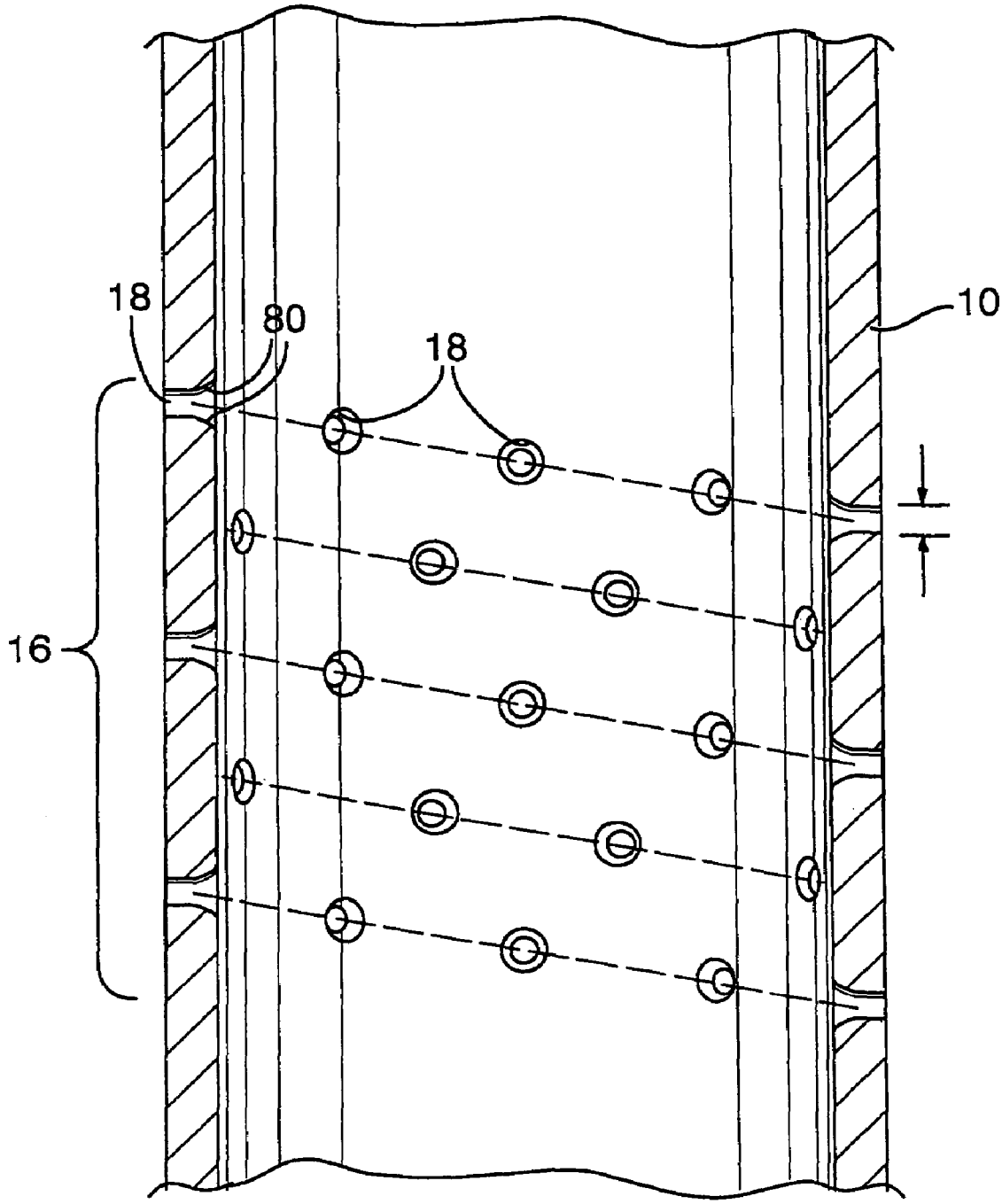
FIG. 6 is a vertical sectional view through a portion of the pipe section of FIG. 1 and shows an exemplary pattern of water recharge orifices.

FIG. 6 illustrates the section of pipe 16 having the apertures 18. Again, it should be noted that at least one such aperture is provided. However, it is more desirable to include a plurality of apertures spaced about the circumference of pipe section 10. This approach disperses the water being used to recharge the aquifer through a plurality of openings and reduces the mining of the aquifer that could otherwise take place by a high volume of water passing through one or only a few apertures toward the aquifer. The size and number of apertures may be varied for a particular application. That is, for a given head pressure during recharging of a well and a desirable flow rate of recharge water into the aquifer, one can determine the number and size of apertures that are required. In the illustrated embodiment, forty openings are provided which are each one-fourth inch in diameter. These openings are desirably arranged in a spiral pattern as shown in FIG. 6 as opposed to being in respective rings with each ring being at the same elevation. As a result, the integrity and strength of the pipe is increased. Although less desirable, the openings may be arranged in rings or other arrangements. In addition, as the valve is moved upwardly or downwardly, the change in the exposed orifices is almost linear. This facilitates the control of a flow rate during aquifer recharge operations. As shown in FIG. 6, for one of the apertures 18, the apertures may have rounded edges 80 at the interior side of the pipe section 10 to facilitate the smoother flow of water through the apertures during an aquifer recharge operation. This also reduces the possibility of the apertures scratching the valve 20 as it is slid past the apertures.

In the illustrated example with forty apertures of one-fourth inch diameter and with a valve head pressure of 520 feet of head, the flow rate through all the apertures is about 1970 gallons per minute. In general, this flow would be distributed equally through the various apertures. In this example, it is assumed that all forty apertures are open.

If single action cylinders are used, the cylinders are always pushing against and reinforcing the cage.

Figure 7:
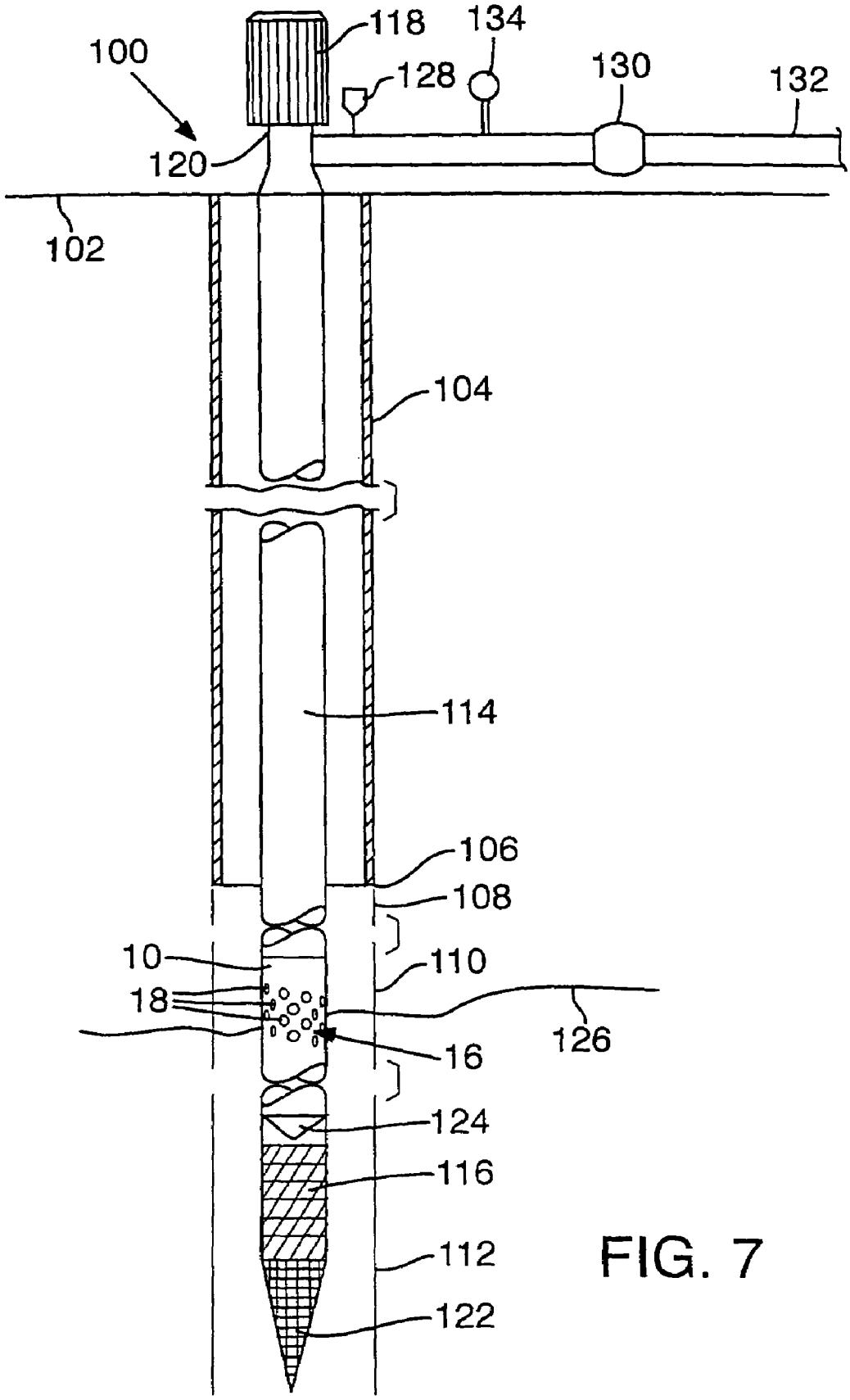
FIG. 7 illustrates an exemplary well with a recharge valve of FIG. 1 installed.

In one specific application shown in FIG. 7, a well 100 is indicated and extends downwardly from ground surface 102. In this example, the upper portion of the well has a well casing 104 which in this example ends at 106. The well casing may be any depth and typically depends on soil conditions. A well is typically cased deep enough to minimize the possibility of collapsing of the walls of the well. The lower uncased portions of the well are indicated at 108, 110 and 112. A pump column is indicated at 114 with pipe section 10 being included in the pump column. One or more pump bowls are indicated at 116 with respective impellers (not shown) driven by an electric or other motor 118 located at the well head 120. A screen is illustrated at 122 for blocking the passage of grit into the pump bowls 116. A check valve 124 restricts the downward flow of water through the valve toward the pump bowls. The static water level in the well is indicated in this example at 126. A conventional vacuum 128 maintains a vacuum in the line in a conventional manner to self-prime the pump. A flow rate meter 130 (with a McCrometer Model MW506, Option #10 with bi-directional capabilities (indicates flow in each direction) from McCrometer of Hemet, Calif. being one suitable example) to monitor the water flow rate. A portion of a water discharge pipe (during pumping operations) is indicated at 132. Pipe 132 may function as a supply pipe during aquifer recharge operations. Pressure at the well head may be monitored by a pressure gauge 134. It should be noted that other types of pumps may be used as the aquifer recharge valve is not limited to use with the type of pump depicted in FIG. 7.

Figure 8:
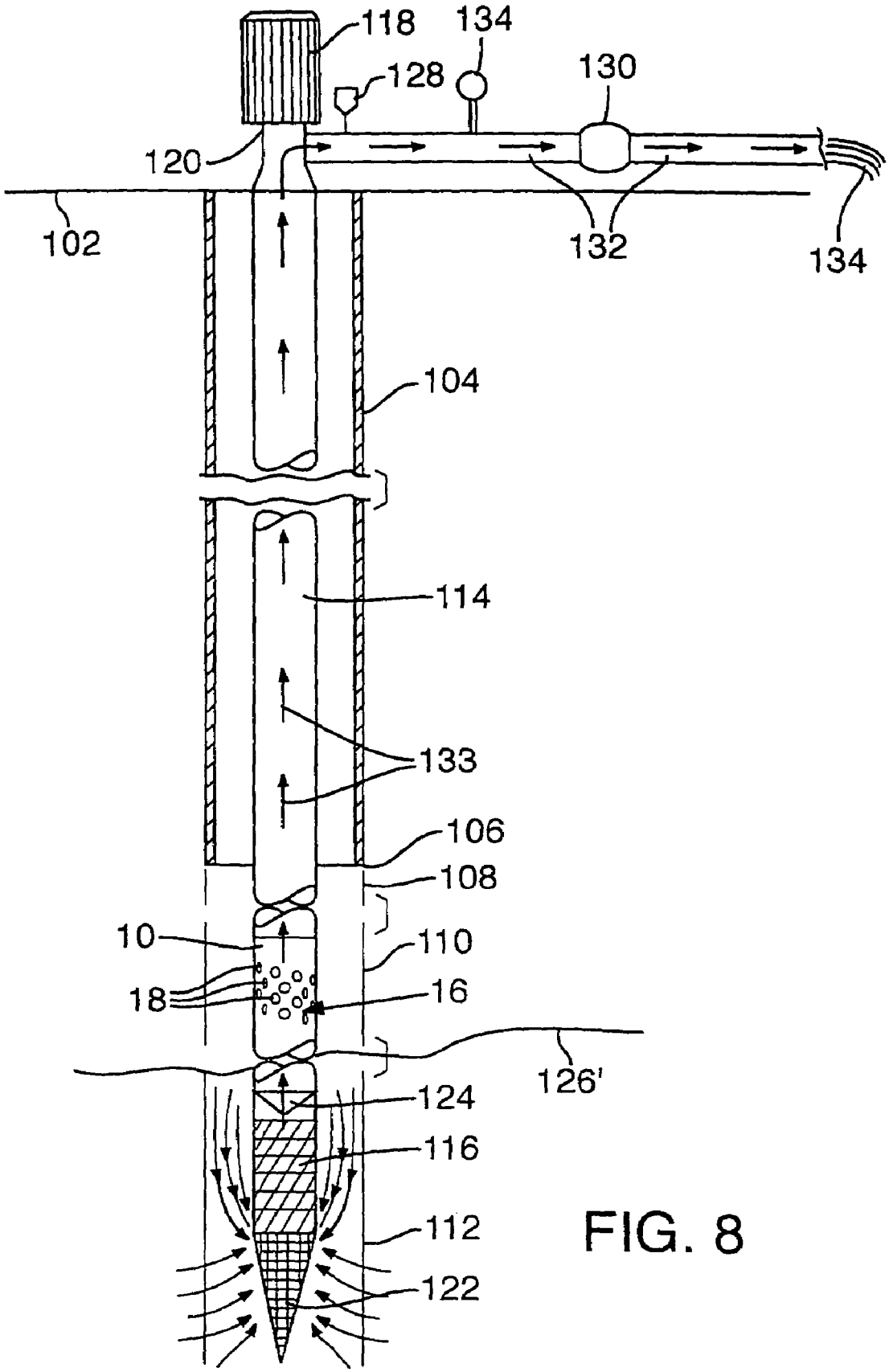
FIG. 8 is a view similar to FIG. 7 with the valve closed and showing water being pumped from the well.

FIG. 8 illustrates the embodiment of FIG. 7 in which the well is being operated in a normal pumping operation. In this case, the valve 20 has been shifted to a closed position to block the flow of water through apertures 18. As the pump operates, water passes screen 122 and flows in the direction indicated schematically by arrows 133 to the surface of the well and through discharge pipe 132. The water is indicated schematically at 134 exiting from pipe 132. Check valve 124 prevents the backflow of water through pump bowls 116. In this figure, the water level 126' is schematically shown as having a concave dip as water is being drawn from the aquifer into the pump column. No water is shown flowing through openings 18 as these openings are closed in this specific example.

Figure 9:
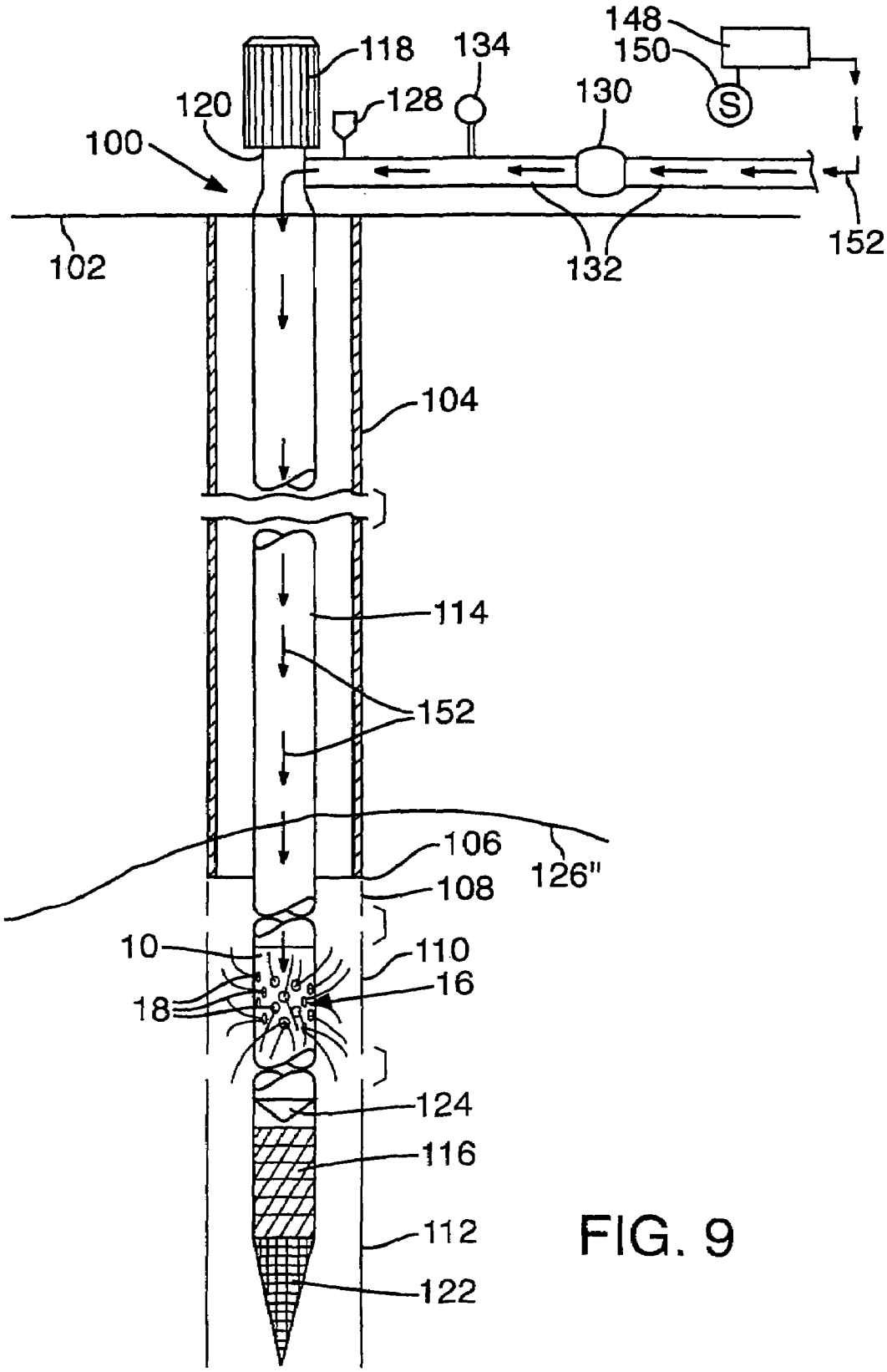
FIG. 9 is a view similar to FIG. 7 with the valve open and water being recharged into the aquifer.

Next assume it is desired to shift from the conditions of FIG. 7 or FIG. 8 to the aquifer recharge operation shown in FIG. 9. In making this transition, the valve 20 is closed (or remains closed if it is already closed) to block the flow of water through the apertures 18. The pump is turned on to force water to the surface to fill up the pump column (if it is not already full). The pump is then shut off. The check valve 124 holds the column of water in the pump column. One fills the column and any pipe connected thereto with water so that air is not injected into the aquifer during recharge operations. Any such injected air can plug the aquifer. A pump, such as surface pump 148, is then energized to deliver water from a source 150 (such as a reservoir, lake, stream, tank or other storage area) in a direction indicated schematically by arrows 152 into pipe 132 and the well head. A positive pressure is maintained at the well head such as 10–20 psi. The valve is then opened by raising the cage with the extent of the valve opening being controlled to match the water flow rate into the well head at the surface. A controller, such as a programmable logic controller, may be used to control the positioning of the valve so that these flow rates are maintained in a manner that keeps a positive pressure at the well head. Thus, if the pressure drops, the valve 20 may be shifted to close the valve to a greater extent. If the pressure rises, the valve 20 may be opened to a greater extent. The valve 20 may be controlled by a hydraulic motor coupled to the respective cylinders 40,42 and operable in response to the controller as explained below. As shown in FIG. 9, under these conditions the water level 126" is shown elevated as water is being injected into the aquifer through the openings 18. Check valve 124, in this example, prevents the water from flowing backward through the pump bowls. When it is desired to stop recharging the aquifer, the valve 20 may be closed to block the openings 18. In addition, the valve 20 may be opened to drain the water column to its static level (see FIG. 7).

Figure 11:
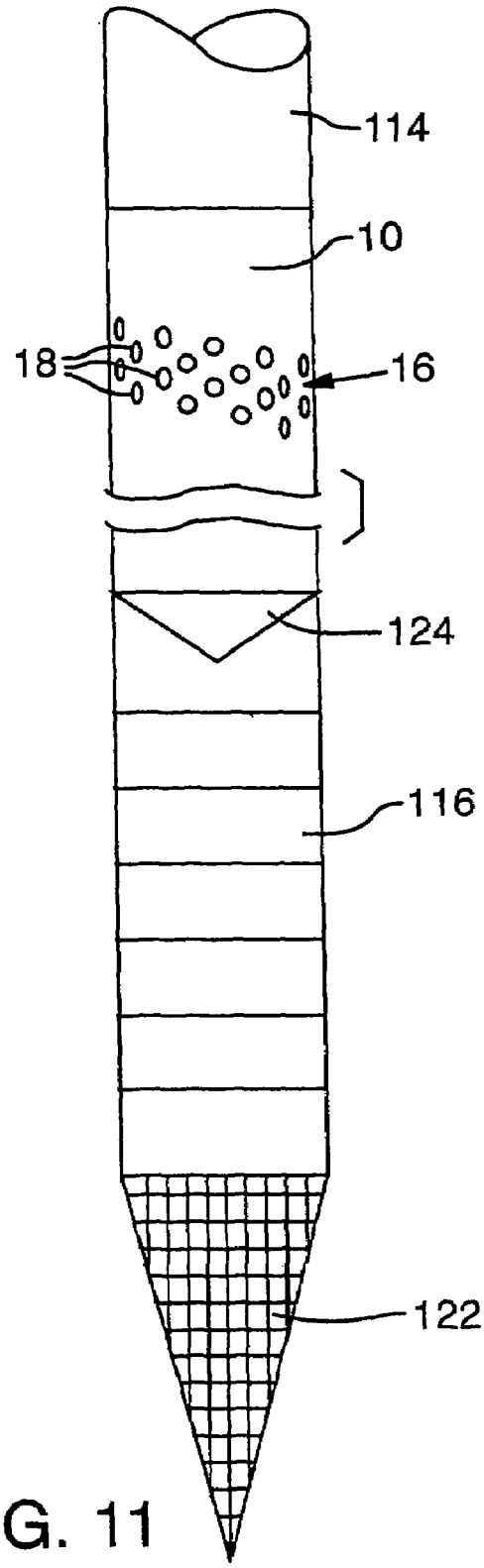
FIG. 11 illustrates an application with the valve positioned above the pump (similar to FIG. 7).

FIG. 11 is an enlarged view of a portion of the construction described in connection with FIGS. 7–9.

Figure 10:
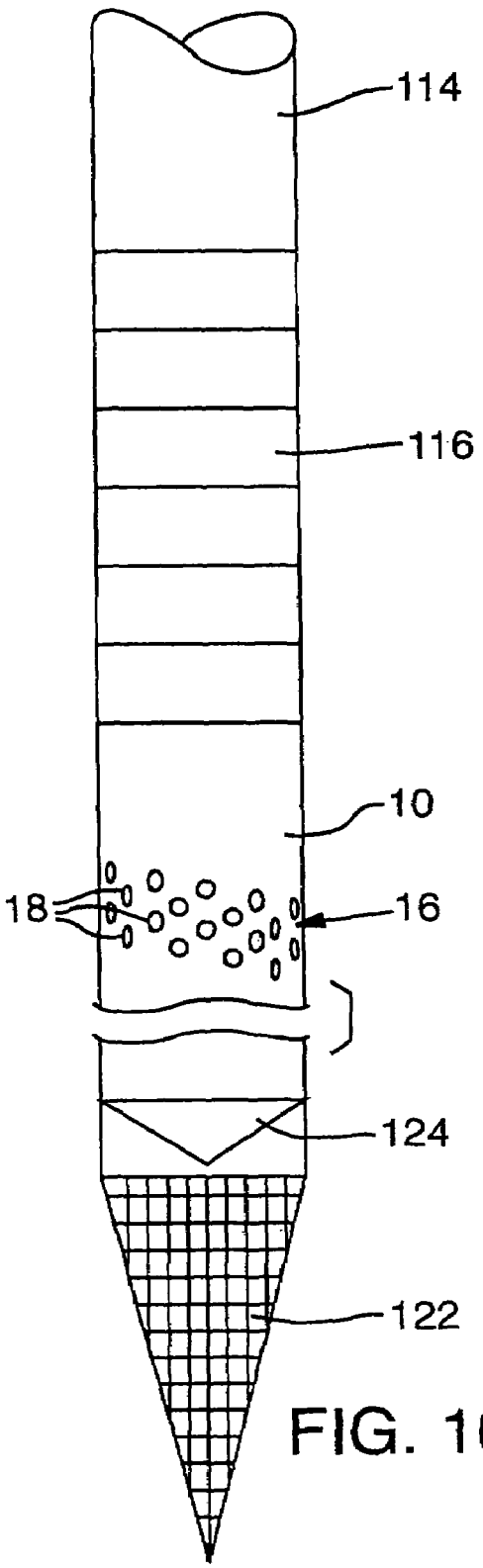
FIG. 10 illustrates an application in which the valve is positioned below the pump.

FIG. 10 illustrates an alternative construction in which the check valve 124 and aquifer recharge valve are positioned below the pump bowls and suction of the pump.

Figure 12:
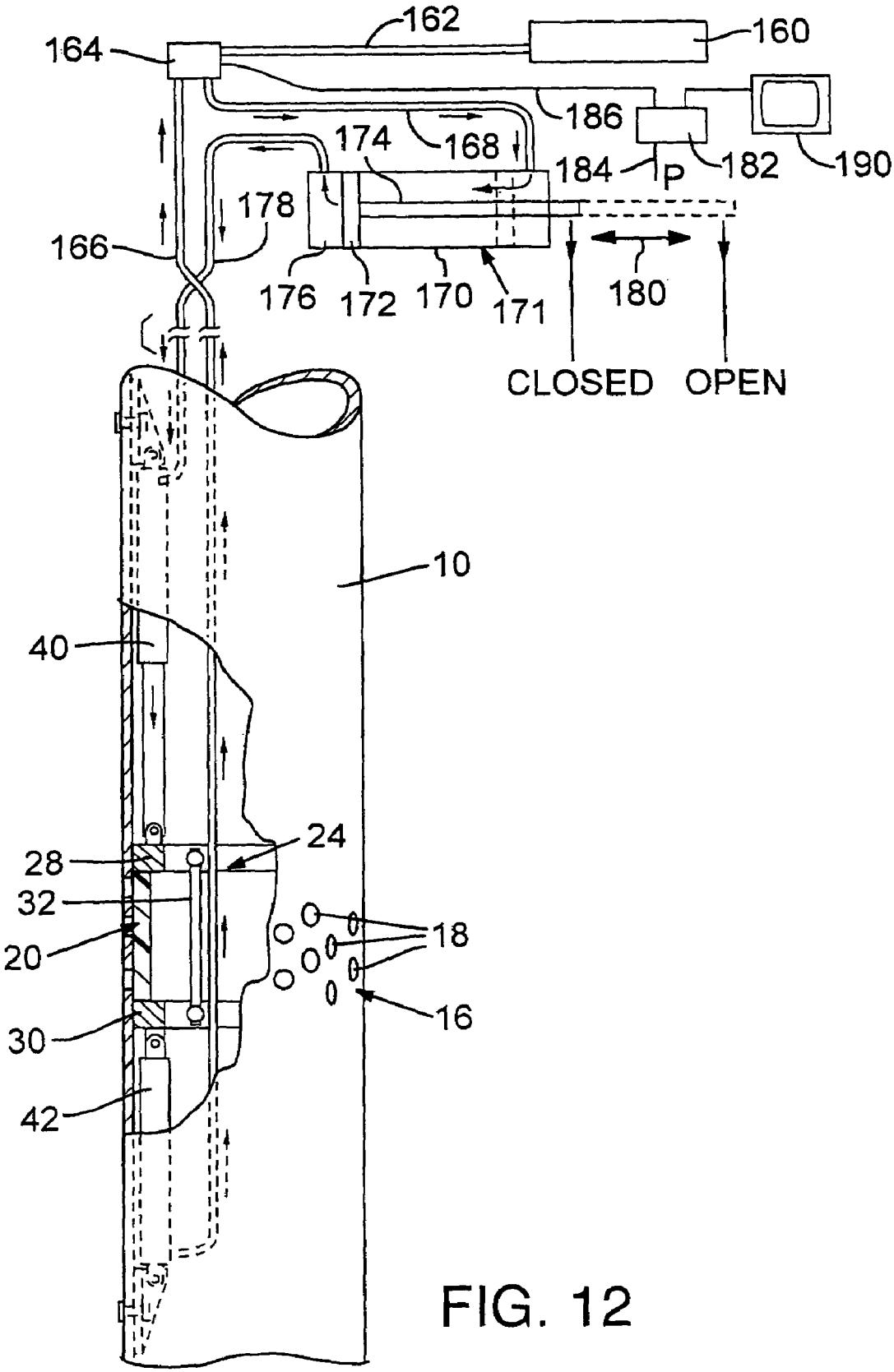
FIG. 12 illustrates one form of control for shifting the valve between open and closed positions with the valve shown in a closed position in FIG. 12.
Figure 13:
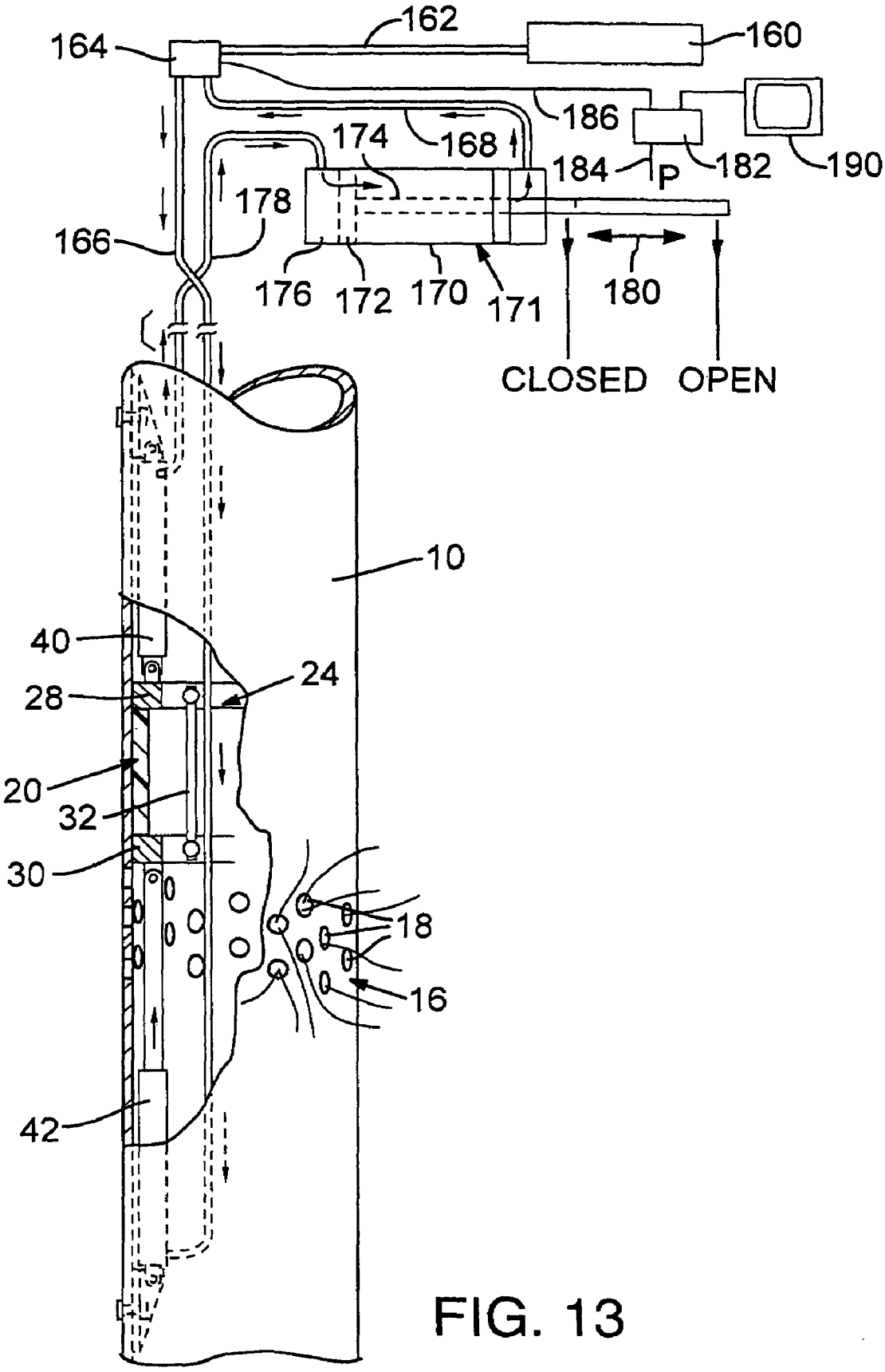
FIG. 13 is a view similar to FIG. 12 except the valve is shown shifted to an open position in FIG. 13.

FIGS. 12 and 13 illustrate an exemplary embodiment of a control useful in controlling the opening and closing of the valve 20.

In FIG. 12, the valve 20 is shown shifted to a closed position. In this example, a hydraulic pump 160 is coupled by a line 162 to a hydraulic pump control valve 164. Valve 164 is coupled to a line 166 extending from pump control valve 164 to the cylinder housing end of the cylinders 42. A line 168 may be coupled from control valve 164 to the cylinder housing end of the cylinders 40. However, in the illustrated embodiment, line 168 is coupled to one end portion 170 of a chamber 171. A piston 172 is positioned within chamber 171. An indicator, such as a rod 174, is coupled to piston 172 and projects outwardly from chamber 171. A second chamber 176, at the opposite side of piston 172 from chamber 170, is coupled by a line 178 to the cylinder housing end of the respective cylinders 40. When valve 164 is in the position shown in FIG. 12, hydraulic fluid is passed through line 168 into chamber 170 to drive piston 172 to the left in this figure. Piston 172 in turn forces hydraulic fluid from chamber 176 into line 178 and to the cylinder housing end of cylinders 40 to extend cylinders 40 and drive the valve 20 to a closed position. At the same time, hydraulic fluid is bled from the cylinder housing end of cylinders 42 via line 166. The position of the exposed end of rod 174 provides a visual indication of the extent to which the valve 20 is closed. Indicia and a pointer on the rod which moves along the indicia may be used to indicate the valve position. The rod comprises one form of a piston extension. Other mechanisms for detecting and visually indicating the position of the piston, and thereby of the recharge valve, may also be used. Remote indication of the valve position may also be provided. For example, a potentiometer may be coupled to rod 174 and be included in a circuit which provides an electrical signal at a remote location (spaced from the rod and desirably spaced from the well head) to indicate the position of the rod and thus the position of valve 20. In FIG. 12, the valve is shown in its fully closed position. The fully opened position is also indicated in FIG. 12. Components 160, 164 and 171 are typically above the ground where they are readily accessible and where it is easy to visually observe the position of rod 174. In general, during an aquifer recharge operation, piston rod 174 is movable in the direction as indicated by arrows 180 to various positions between the fully closed and fully opened position. A programmable logic controller 182 receives an input signal on line 184 which corresponds to the pressure P at the well head. Controller 182 is programmed to send a signal along line 186 to hydraulic pump control valve 164 to control the operation of the control valve to in turn shift the valve 20 toward open or closed positions to maintain the pressure at the well head within desired limits (e.g., 10 to 20 psi). A monitor or other visual display device 190 may also be included to provide further indications of the operating conditions of the system during aquifer recharging. Other indicators may alternatively be used.

Typically, food grade hydraulic fluid is used so as to protect the water supply in the event the hydraulic fluid leaks from the system. Although other lines may be used, the lines 166, 178, for example, may be one-fourth inch diameter stainless steel tubing.

The volume of chambers 170, 176 may be such that movement of piston rod 174 between the open and closed positions corresponds to the movement of the valve 20 between respective fully open and fully closed positions.

Although other components may be used, one exemplary control valve 164 is a Model No. 202-304 solenoid valve from Chief Manufacturing. A suitable logic controller 182 is a Panel View Model 300 controller from Allen Bradley.

FIG. 13 shows valve 20 as it is shifted to its fully opened position. In this case, hydraulic fluid is delivered through line 166 to the housing end of cylinders 42 to extend these cylinders and shift the valve 20 upwardly in FIG. 13. At the same time, hydraulic fluid passes from the housing side of cylinders 40 through line 178 and into chamber 176. Fluid from chamber 170 is bled through line 168.

Other control systems for controlling the operation of cylinders 40 and 42 to shift the valve 20 may be used as alternatives. For example, mechanisms such as a manual two-way spool valve may be used to control the shifting of valve 20.

Figure 14:
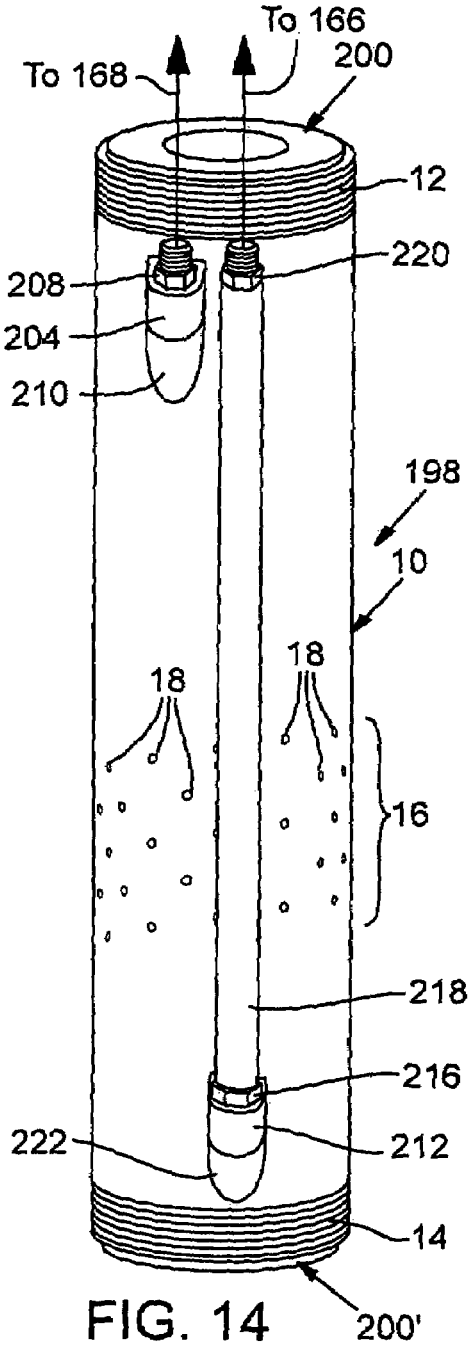
FIG. 14 illustrates another embodiment of a recharge valve assembly.

With reference to FIG. 14, another form of recharge valve assembly 198 comprises a pipe section or housing 10 having at least one water flow opening, and more desirably a plurality of openings 18, extending through the pipe section. The apertured area of pipe section 10 is indicated by the number 16 in FIG. 14. The apertures may be of any suitable size and pattern such as the size and pattern shown in FIG. 6 and as previously described. Consequently, the apertures will not be discussed further in connection with this embodiment.

The embodiment of FIG. 14 may use a valve 20 and other components as previously described. Also, the operation of the valve of FIG. 14 may be as previously discussed and may use a control system as described above.

Figure 15:
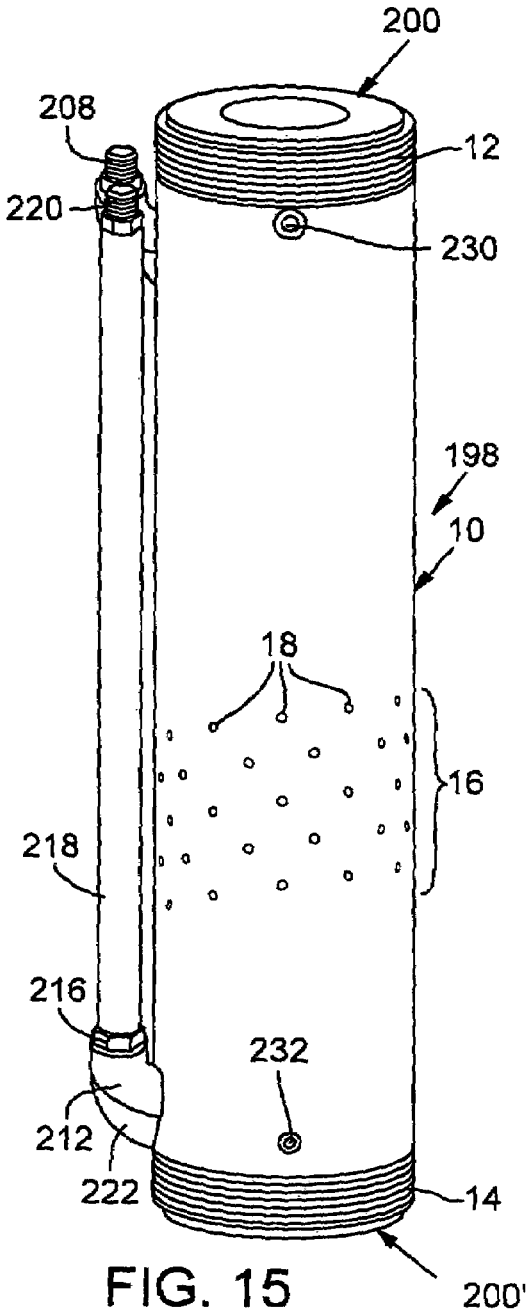
FIG. 15 illustrates the recharge valve assembly embodiment of FIG. 14 rotated about 90 degrees from the position of the recharge valve assembly shown in FIG. 14.

The illustrated recharge valve assembly 198 comprises first and second end members, such as end caps 200,200' respectively inserted into the top and bottom of the pipe section 10 of the valve assembly shown in FIG. 14. Exemplary end cap portions 200,200' are described in greater detail below and may be identical to one another. A first coupler 204, mounted to the exterior of housing 10, defines an internal passageway 205 (FIG. 17) communicating with the interior of a portion of housing 10 through a corresponding port or passageway 206 in the housing. A hydraulic line fitting 208 (FIG. 14) may be secured to coupling 204, such as being threaded into a threaded fitting receiving portion of the coupling. A hydraulic line (not shown in FIG. 14) may be connected to fitting 208 when the valve assembly is in use. This line may, for example, correspond to the line 168 in previously described embodiments, such as the embodiments of FIGS. 12 and 13. A tapered deflector 210 may be positioned at the underside of fitting 204 (and may, for example, be a part of fitting 204). The deflector 210 deflects the valve assembly away from obstructions as the valve assembly and well pipe containing the assembly is lowered into a well. Deflector 210 also shields the coupling 204. In addition, in the embodiment of FIG. 14, a second coupler 212 defines a hollow interior passageway 213 communicating through a port 214 (FIG. 17) with the interior of the housing or pipe section 10. Coupler 212 may be internally threaded so as to receive a hydraulic line fitting 216 (FIG. 15) and the lower end of a hydraulic line section 218. The upper end of line section 218 terminates in a hydraulic fitting 220 that may be coupled to a hydraulic line, such as line 166 (FIGS. 12 and 13), when the valve assembly is in use. A tapered shield or deflector 222 may be positioned below coupler 212 and functions in the same manner as deflector 210. The ports 206, 214, that communicate through respective openings 205,213 of the respective couplings 204,212, are desirably offset from one another so that fittings 208,220 clear one another at the upper end of the illustrated recharge valve assembly.

It should be noted that the recharge valve assembly 198 may be used in other orientations, such as inverted from the orientation shown in FIG. 14. In such a case, the couplers 204,212 may also be inverted.

As explained below, the respective end caps 200,200' may be inserted into the respective ends of pipe section 10 and desirably are threaded into the pipe section. In addition, retainers, such as set screws 230,232 (FIG. 15), may be used to engage the respective end caps 200,200' to prevent them from separating from the pipe section 10 during use. The illustrated set screws 230,232 are each threaded through a respective set screw receiving opening of the pipe section 10 and into engagement with the respective end caps.

Figure 16:
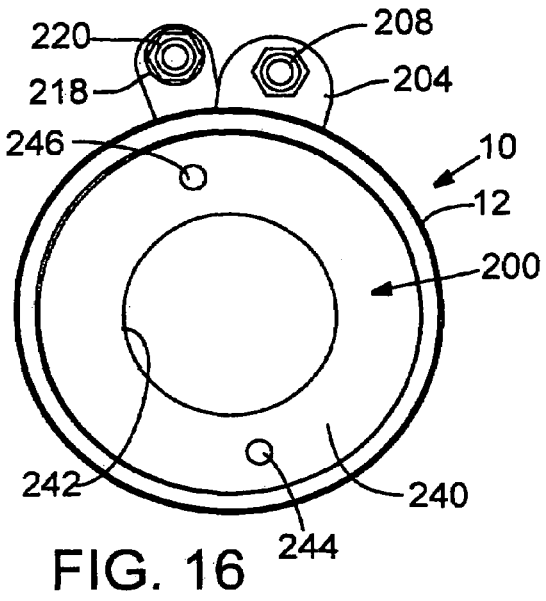
FIG. 16 is a top view of the recharge valve assembly embodiment of FIG. 14.
Figure 18:
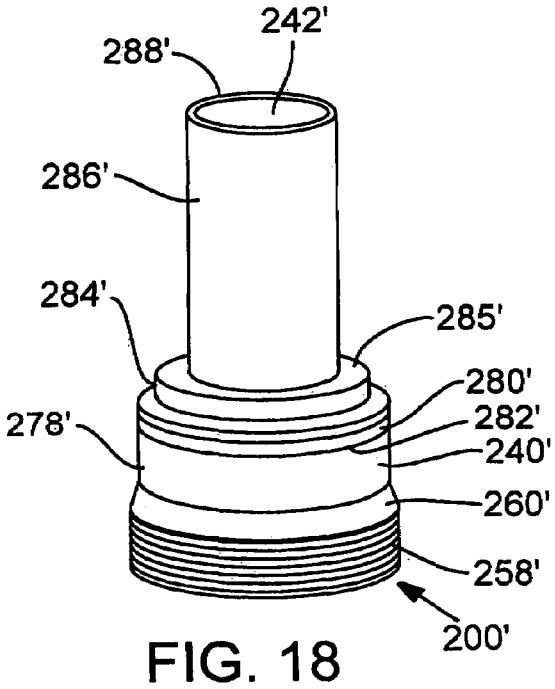
FIG. 18 is a perspective view of an exemplary end cap for insertion into one end of the pipe section of FIG. 17.

With reference to FIGS. 16 and 18, end cap 200' may be identical to end cap 200. For this reason, portions of end cap 200' are assigned the same number as corresponding portions of end cap 200, except that a prime (') is added to the components of end cap 200'. End cap 200' is desirably of an annular construction with a body 240' (FIG. 17) provided with a longitudinally and axially extending water flow opening 242'. The water flow opening 242' may be circular in cross-section and may have a diameter that is varied depending upon factors such as the diameter of the well pipe with which the recharge valve assembly 198 is to be used. For example, a valve for use with 6 inch outside diameter well pipe, that has approximately a 5 inch inside diameter, may have end cap openings that are 2.872 inches, as a specific example. In other words, the end cap openings, in this example, are approximately 3 inches in diameter. As another example, a recharge valve assembly for eight inch well pipe may have end caps with respective longitudinally extending openings that are 4 inches in diameter. Also, a recharge valve assembly for ten inch well pipe may have end caps with center openings of about 6 inches in diameter. Again, these dimensions may be varied. The length of the valve assembly may be relatively short. For example, length L in FIG. 17 may be 28 inches. Because of the shortness of recharge valve assembly of the illustrated example, even with a somewhat restricted opening 242, little pressure loss occurs across the recharge valve as water flows through the valve assembly.

In the embodiment of FIG. 16, the end cap 200 is provided with first and second blind holes 244, 246 which are diametrically located across the end cap body 240 and are exposed at the surface of the body of the end cap 200. A tool, such as a wrench having projecting pegs positioned for insertion into the respective openings 244,246, may be used to tighten the valve end cap 200 within the end of pipe section 10 and also to remove the end cap 200, as desired. End cap 200' is desirably also provided with corresponding blind holes.

Figure 17:
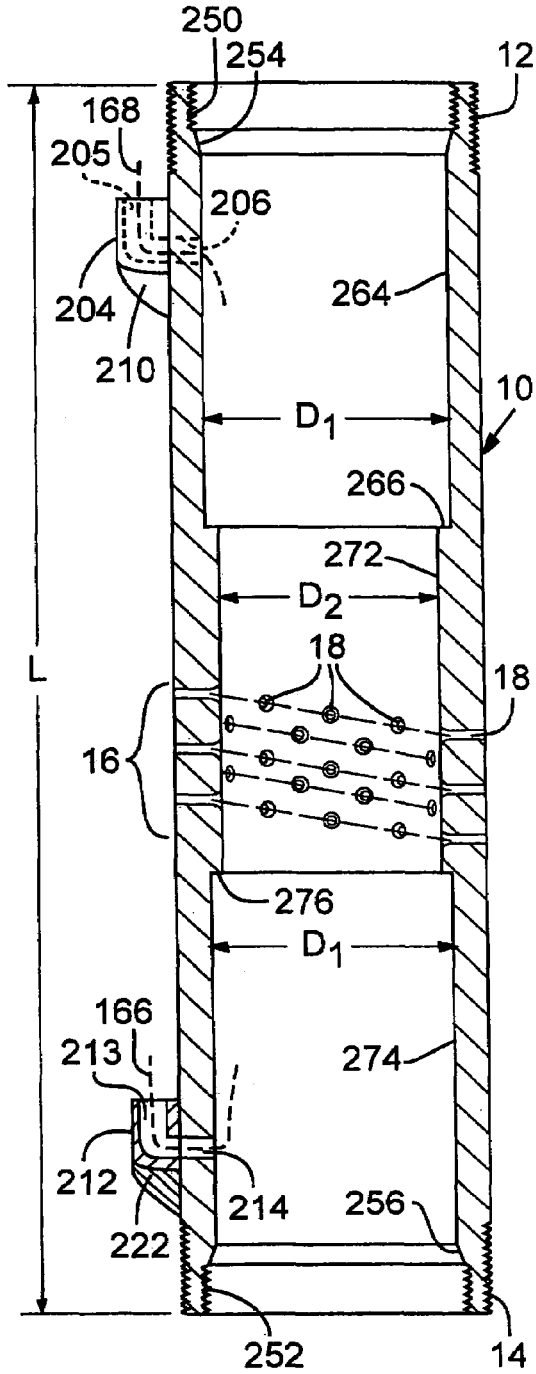
FIG. 17 is a longitudinal sectional view of a pipe section portion of the recharge valve assembly embodiment of FIG. 14.

With reference to FIG. 17, one form of pipe section 10 for the valve assembly of FIG. 14 is illustrated. The illustrated pipe section 10 has exterior threads 12,14 at the respective ends of the pipe section for coupling to other lengths of well pipe when the valve assembly is installed for use. The upper end portion of pipe section 10 has internal threads 250 for threadedly receiving external threads 258 (FIG. 23) on the body 240 of end cap 200 for use in threadedly interconnecting these members. In the same manner, the lower end of pipe section 10 is provided with internal threads 252 (FIG. 17) for threadedly receiving a threaded portion 258' (FIGS. 18,23) of the end cap 200'. Interiorly (meaning toward the center of pipe section 10) of threads 250, an annular tapered wall section 254, of a diameter that is reduced in a direction extending inwardly into the interior of pipe section, is provided for engaging a corresponding shoulder 260 (FIG. 23) of cap member 200 to limit the extent to which cap member 200 may be inserted into the pipe section. Therefore, when cap member 200 is threaded into the pipe section 10 and shoulder 260 bottoms out against wall section 254, the position of cap member 200 is at a known established location. A similar tapered annular shelf 256 (FIG. 17) is provided at the lower end of the pipe section 10.

A first wall section 264 is positioned inwardly of tapered section 254. Wall section 264 is of a first cross-sectional dimension, and in this example, is a right cylinder having a diameter D1. The dimension D1 may be varied depending upon the size of the recharge valve assembly, such as with the diameter of the well pipe with which the valve assembly is to be used. Although variable, for a pipe section 10 having a six inch outside diameter, dimension D1 may be, for example, about 5.4 inches. A portion of the wall surface 264 in this embodiment desirably defines a portion of a hydraulic chamber 265 (FIGS. 23,24) as explained below. The assembly desirably includes a piston stop for limiting the motion of one or more pistons within the valve assembly. Although various forms of a stop (e.g., projections) may be used, in one specific example, the piston stop comprises a shelf 266 of an annular configuration that is formed in the interior surface of pipe section 10 at the inward end of wall section 264. A valve guiding wall section 272 of a second cross-sectional, in this example diameter D2, is positioned inwardly of shelf 266. The valve 20 may slide along wall section 272 to respectively open and close the openings 18 through the pipe section 10 depending upon whether, and to the extent, the valve 20 overlies the openings 18.

As can be seen in FIG. 17, in the orientation shown, an upper portion of wall section 272 is provided without the openings 18. When the valve 20 is moved to a position adjacent the upper portion of wall section 272, the valve desirably does not impede the flow of water through the openings 18. Conversely, as the valve is shifted downwardly in FIG. 17 to a position which overlies some or all of the openings 18 (all of them desirably being overlaid when the valve is in its lowermost position), the flow of water through openings 18 is impeded or blocked. The extent of such blockage depends upon the valve position. The diameter D2 may also be varied. In one specific example, the diameter D2 is 5 inches for a six inch outside diameter pipe section 10. The lower portion of pipe section 10 in the illustrated embodiment also comprises a wall section 274 positioned inwardly of annular tapered wall section 256. Wall section 274 may also be a right cylinder and desirably defines a portion of a hydraulic chamber 265' (FIGS. 23,24) in this specific example. Wall section 274 may have the same diameter D1 as wall section 264. The inwardmost end of wall section 274 terminates in an annular piston stop 276 which is like stop 266. Other forms of a piston stop may be used in the lower portion of the pipe section.

FIG. 18 illustrates an embodiment of an exemplary lower end cap 200'. Cap 200' comprises external threads 258' for threading into the threads 252 of the pipe section 10. An annular tapered shoulder section 260' of end cap body 240' is provided to engage annular wall surface 256 of pipe section 10 when these components are assembled. The body 240' of end cap 200' may also comprise a cylindrical wall portion 278' having an outside cross-sectional dimension, such as a diameter, that desirably corresponds to and is slightly less than the diameter D1. End cap wall portion 278' desirably is sealed against the wall section 274 when end cap 200' is in place. For example, wall section 278' may be provided with at least one inwardly extending seal receiving groove 280' within which a seal, such as an O-ring 282', is placed. The O-ring 282' seals the space between wall section 274 and wall portion 278' and thus seals the base of the recharge valve assembly and the hydraulic chamber 265' (FIGS. 23, 24) at this location.

The body 240' desirably has a wall portion or section 284' that is of a reduced cross-sectional dimension at a location adjacent to wall section 278'. The wall section 284' is positioned further inwardly into pipe section 10 than the wall section 278. As a result, an annular passageway 287' (FIG. 23) is provided to facilitate the flow of hydraulic fluid through opening 214 and into the hydraulic fluid receiving chamber 265' as described below. Body 240' may include an annular shelf or piston stop surface 285' operable to limit the movement of a piston in the direction toward the adjacent end of the pipe section 10. Other forms of piston stop may be used. Body 240' also comprises, in this embodiment, a piston guide such as a cylindrical piston engaging wall section 286'. Wall section 286' is of a reduced diameter in comparison to wall section 274. The wall section 286' terminates in an end portion 288'. The fluid flow opening 242' passes axially through projection 286' and through the other portions of body 240' to the exterior end cap 200'. The wall surface 286' comprises one form of an annular piston guiding surface along which a piston may be shifted. The wall surface 286' desirably defines a portion of the hydraulic chamber 265'. Other portions of the chamber 265' are defined, in this example, by the sections 284', 285' of the end cap 200' and by a portion of wall section 274. This will become more apparent from the discussion below.

Figure 19:
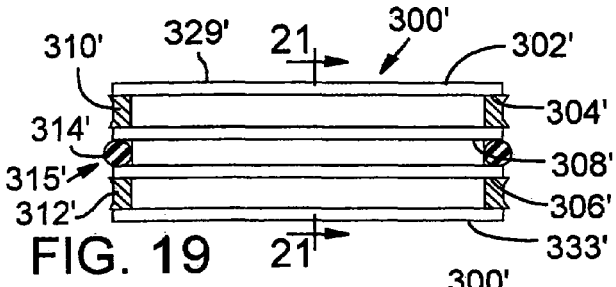
FIG. 19 is a side elevational view of one form of a piston slidable along an extension portion of the end cap of FIG. 18.
Figure 20:
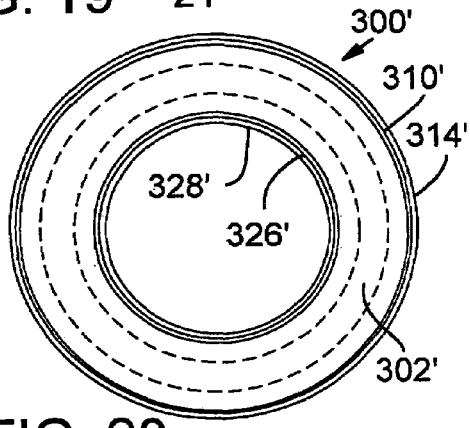
FIG. 20 is a top view of the piston of FIG. 19.
Figure 21:
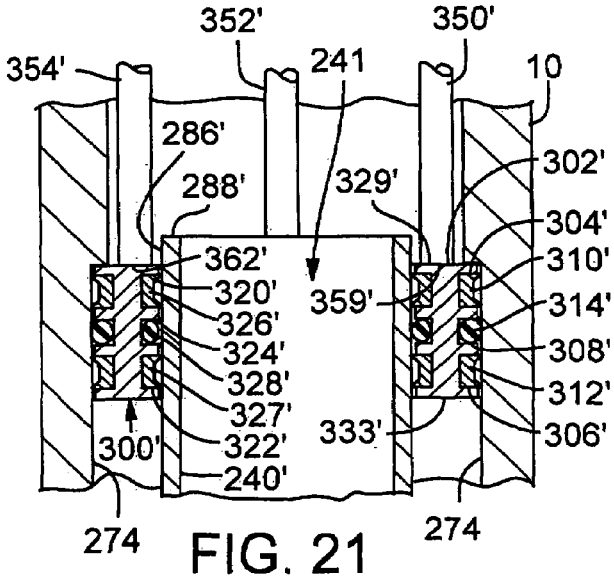
FIG. 21 is a cross-sectional view through the piston of FIG. 19, taken along line 21—21 of FIG. 19, and with the piston installed on an end cap extension within the recharge valve assembly of FIG. 14.

FIGS. 19, 20 and 21 illustrate an exemplary form of annular piston 300' that may be employed in the recharge valve assembly 198 of FIG. 14. The construction of the piston 300' may be varied. The recharge valve assembly desirably comprises a double acting hydraulic cylinder with, in reference to FIGS. 23 and 24, upper and lower pistons, 300,300'. Since these pistons are desirably identical, although not required, only lower piston 300' will be described in detail. Components of piston 300' that correspond to components of piston 300 are assigned the same number, but with a prime (') designation. With reference to FIG. 19, the illustrated piston 300' comprises an annular body 302'. The body 302' defines upper and lower spaced apart wear ring receiving grooves 304',306' extending inwardly into the body. In addition, a seal receiving groove 308', is provided intermediate to and spaced from the respective grooves 304' and 306'. A wear ring 310' is positioned within groove 304' and a second wear ring 312' is positioned within groove 306'. A seal, such as an O-ring 314', is positioned within the groove 308'. The wear rings 310',312' may be of ultra high molecular weight polyethylene or other low friction durable material. The outside diameter of each wear ring 310',312' is slightly greater than the outside diameter of the body 302' so that, when in position, the wear rings bear against the wall surface 274 (or surface 264 in the case of piston 300 and its wear rings). The O-ring 314' seals the space between the piston 300' and the adjoining wall section 274. The periphery of piston 300' defines an exterior annular piston surface 315' for sliding along a portion of wall section 274.

As can best be seen in FIG. 21, the piston body 302' also defines upper and lower inwardly extending interior wear ring receiving grooves 320',322' that are spaced apart from one another and an inwardly extending interior seal receiving groove 324' between the grooves 320',322'. Respective wear rings 326',327' are received in the respective grooves 320',322'. In addition, at least one seal, such as an O-ring 328', is received within the groove 324'. The O-rings 314', 328' are typically of rubber or other suitable seal material. The wear rings 326',327' may be of the same material as wear rings 310', 312'. The interior diameter of wear rings 326',327' is less than the interior diameter of piston body 302' so that the wear rings 326',327', when the piston is in position, slide along surface 286' and separate the piston body 302' from the end cap wall surface 286'. The O-ring 328' is sized to seal the gap between end cap wall surface 286' and the piston 300'. Other suitable approaches for sealing a piston relative to an interior pipe section wall surface and end cap projection may also be used. The illustrated piston also defines an annular interior piston surface 329' (FIG. 21) positioned for sliding along the piston guide, in this case, along wall surface 286'. Opposed major annular piston surfaces, one surface 331' facing value 20 and the other surface 333' facing hydraulic chamber 265', are thus included in this piston construction. Surfaces 331' and 333' are separated from one another by the annular surfaces 315' and 329'.

Figure 22:
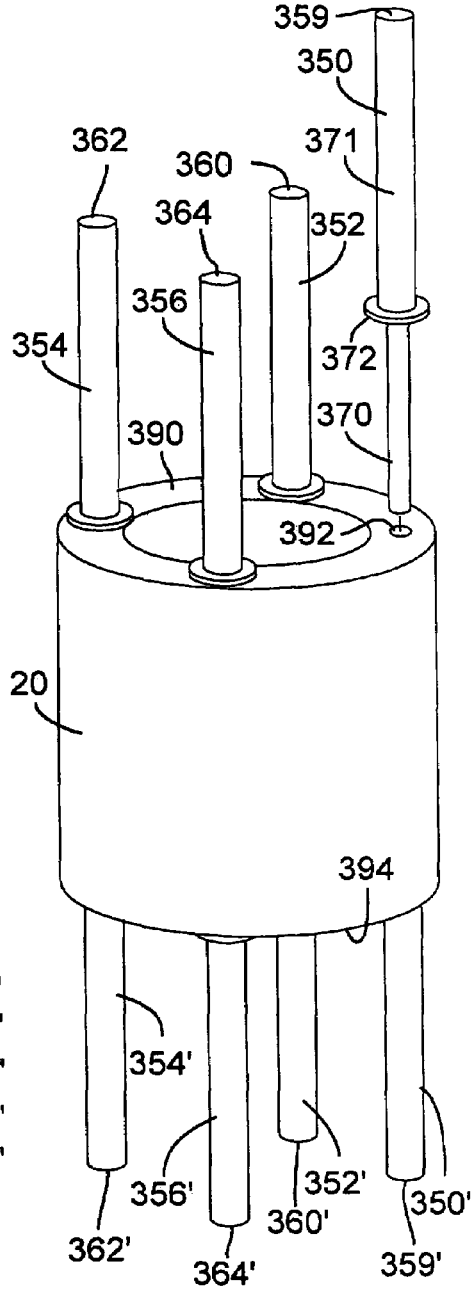
FIG. 22 is a partially exploded perspective view of a form of valve and push rod structure which may be included in the recharge valve assembly of FIG. 14.
Figure 23:
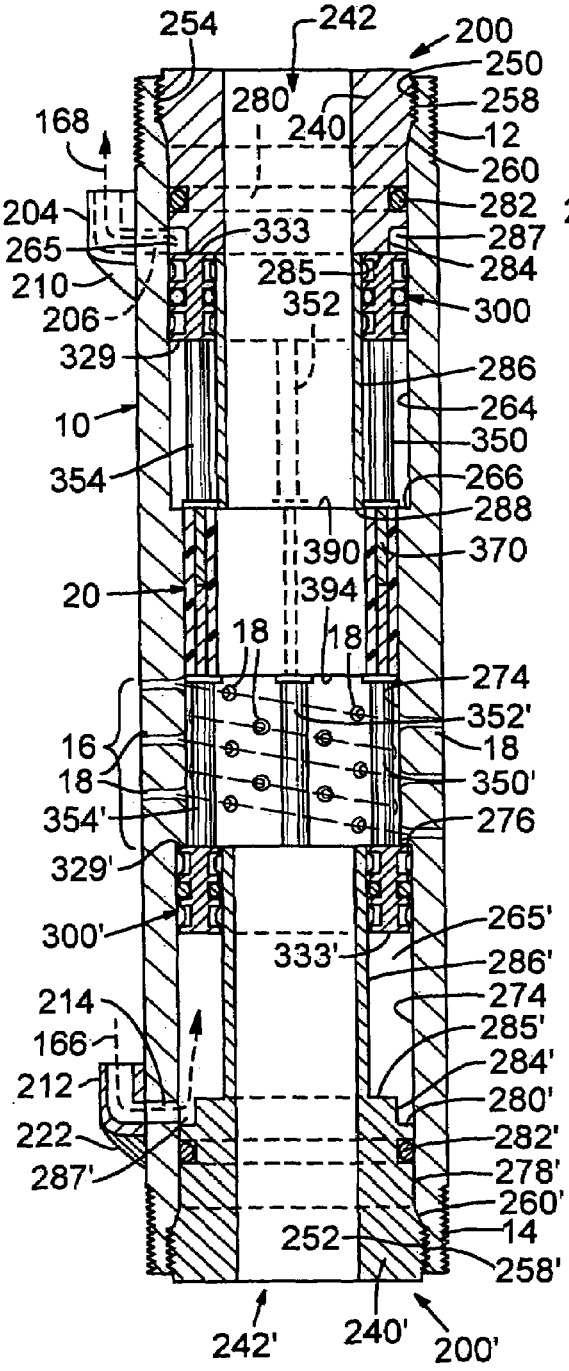
FIG. 23 is a longitudinal sectional view through the recharge valve assembly of FIG. 14 with the valve shown in an open position.
Figure 24:
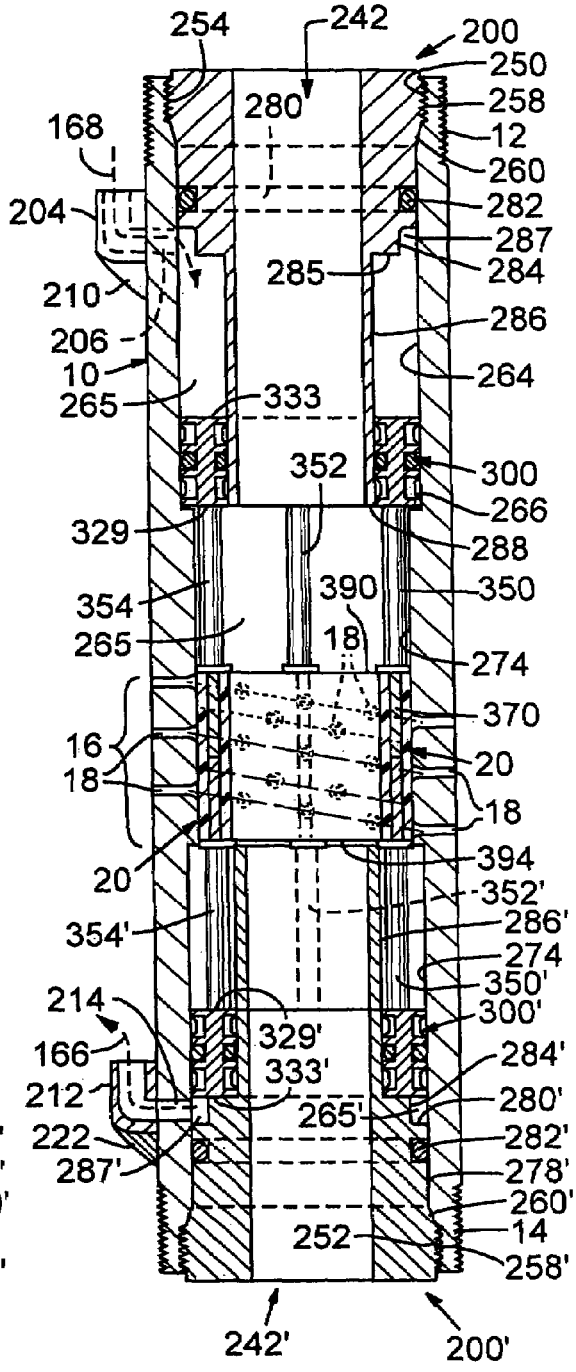
FIG. 24 is a longitudinal sectional view of the recharge valve assembly of FIG. 14 with the valve shown in a closed position.

In FIG. 21, the piston 300' thus corresponds to the lower piston of the recharge valve assembly oriented as shown in FIGS. 23 and 24. The piston surfaces 329,329' (FIGS. 23,24) are each coupled to the valve 20 by a respective pusher or force applying structure, such as a piston to valve engaging structure. In one form, plural push rods, which may be of stainless steel or other suitable material, comprise a form of piston to valve engaging structure. In this example, with reference to FIG. 22, four upper push rods 350, 352, 354 and 356 are shown. As shown in FIG. 23 for three of these rods, the upper ends of these push rods engage the lower surface 329 of the piston 300. Lower push rods 350',352',354' and 356' are also shown in FIG. 22. The lower ends of these latter push rods engage the upper surface 329' of piston 300' as shown in FIG. 23 for push rods 350',352' and 354'. FIG. 22 thus shows an exemplary push rod to valve subassembly. Although a set of four push rods are shown in FIG. 22 in position at each end of valve 20, the number of push rods may be varied. In the embodiment of FIG. 22, the push rods are spaced equally about the circumference of a right cylindrical valve 20. In the case of a valve assembly for use with eight inch well pipe, six push rods is a desirable exemplary number. For a valve assembly for ten inch well pipe, eight push rods are a desirable number. Each of the push rods desirably comprises a piston bearing surface such as surface 359 for push rod 350, surface 360 for push rod 352, surface 362 for push rod 354, and surface 364 for push rod 356. These surfaces bear against the corresponding adjacent major surface of one of the pistons during operation of the valve assembly. Each of the push rods desirably comprises a stem portion of reduced cross-sectional dimension, such as stem portion 370 for push rod 350. Stem portion 370 may be formed, for example, by machining a rod to reduce the diameter of an end portion of the rod to equal the diameter of the stem portion 370. The unmachined end portion of the rod comprises a larger diameter push portion 371 of the push rod construction. An annular member, such as a stainless steel washer 372, may be inserted onto stem 370 and against the lower surface of push rod portion 371 and fastened in place, such as by welding. The diameter of member 372 is desirably slightly less than (e.g., 1/32 of an inch less than) the thickness of the valve 20 so that the edge of member 372 does not engage the adjacent sidewall of the pipe section. For example, for a recharge valve assembly for six inch well pipe, the valve 20 may have a thickness of one-half inch. The diameter of member 372 may, in this case, be, for example, 15/32 of an inch. These dimensions may be varied. The member 372 is provided to increase the surface area that bears against the adjacent end (e.g., end 390 in FIG. 22) of valve 20.

The end 390 is provided with a plurality of stem receiving openings such as opening 392 leading to a bore that extends through the valve 20 from end 390 to end 394. The respective stems of the various push rods are each inserted into a respective associated opening. The stems are desirably sized such that the end of a stem of one push rod bears against the end of the stem of the opposed push rod. Alternatively, a rod section or spacer may be positioned in each bore to engage the ends of the stem portions inserted in the bore. For example with reference to FIG. 23, the end of stem 370 of push rod 350 bears against the corresponding stem 370' of push rod 350' with member 372' bearing against valve end 394 and the corresponding member 372 of push rod 350 bearing against the opposite valve end 390. Consequently, actuation forces are primarily borne by the push rods rather than being applied directly to the valve sleeve 20. This minimizes the possibility of the valve 20 buckling or being crushed or damaged if, for example, one of the pistons 300,300' were to seize for some unlikely reason.

In operation, with reference to FIGS. 23 and 24, the valve 20 may be shifted between a closed and various open positions by applying hydraulic pressure to the appropriate side 333,333' of either piston 300,300'. With reference to FIG. 23, hydraulic fluid is delivered via line 166 and port 214 is delivered into the hydraulic fluid chamber 265' defined by wall section 284', stop surface 285', a portion of wall section 286', the underside 333' of piston 300', and a portion of wall section 274). This urges piston 300' upwardly in the example of FIG. 23 and shifts the valve 20 upwardly. That is, an upward force is applied by piston 300' to the respective push rods (e.g., push rod 350', 352' and 354') against the undersurface 394 of valve 20. The valve may be shifted entirely to its full open position as shown in FIG. 23 with piston surface 333 of piston 300 against stop surface 285 and piston surface 329' of piston 300' against stop surface 276. Alternatively, the motion of valve 20 may be interrupted at a location which partially opens the valve. When open, fluid may flow through the openings 18 that are no longer covered by the valve 20.

In contrast, in FIG. 24 the valve is shown shifted to a fully closed position (shifted downwardly in the example of FIG. 24). In this position, the valve 20 overlies all of the openings 18 (with piston surface 329 of piston 300 against stop surface 266 and piston surface 333' of piston 300' against stop surface 285'). This is accomplished by delivering pressurized hydraulic fluid via line 168 and through port 206 into the hydraulic chamber 265 (defined by a portion of wall section 284, wall section 285, stop surface 285, the top side 333 of piston 300, and a portion of wall section 286). As a result, the valve is urged downwardly in the example of FIG. 24 to a closed (or partially closed) position. That is, hydraulic fluid exerts pressure on side 333 of piston 300 that results in force being applied via piston side 329 and through push rods (e.g., 350, 352 and 354) to the upper valve surface 390. As hydraulic fluid is being delivered via line 166 in FIG. 23 to chamber 265', it is being bled from the chamber 265 at the upper side 333 of piston 300 via port 206 and line 168. Conversely, when hydraulic fluid is being delivered through line 168 to chamber 265, fluid in the chamber 265' at the underside 333' of piston 300' is being removed via line 166.

Having illustrated and described the principles of my invention with reference to several preferred embodiments, it should be apparent to those of ordinary skill in the art that the invention may be modified in arrangement and detail without departing from such principles. I claim all such arrangements that fall within the scope of the following claims.

I claim:

1. An aquifer recharge valve assembly comprising:

a pipe section comprising a wall with an interior surface and an exterior surface;

at least one aperture extending through the wall; and a valve positioned within the interior of the pipe section and movable between a first closed position in which the valve overlies a portion of the interior surface of the wall and the at least one aperture and at least one open position wherein the valve is shifted so as to no longer overlie the at least one aperture at least in part such that aquifer recharge water may flow through the aperture and into the aquifer, wherein the valve has flexibility such that when the valve is in the closed position, a head of water pressure within the pipe section forces the valve outwardly against the overlaid at least one aperture;

a valve actuator for moving the valve between the first closed position and the at least one open position, the valve actuator comprising first and second hydraulic pistons coupled to the valve, a first hydraulic fluid chamber associated with the first piston and a second hydraulic fluid chamber associated with the second piston, one of the first and second pistons being movable in a direction to urge the valve toward said first closed position upon delivery of hydraulic fluid to the hydraulic fluid chamber associated with said one of the first and second pistons, the other of the first and second pistons being movable in a direction to urge the valve toward the at least one open position upon delivery of hydraulic fluid to the hydraulic fluid chamber associated with the said other of the first and second pistons.

2. An apparatus according to claim 1 comprising first and second piston guides coupled to the pipe section, the first piston guide slidably guiding the motion of the first piston and the second piston guide slidably guiding the motion of the second piston.

3. An apparatus according to claim 2 wherein the first and second pistons are each annular, the pipe section comprising respective first and second end portions, the apparatus comprising first and second end members, the first end member being coupled to the first end portion of the pipe section, the first piston guide projecting from the first end member and inwardly into the interior of the pipe section, the first piston guide comprising a first annular exterior piston guide surface for guiding the motion of the first piston, the second end member being coupled to the second end portion of the pipe section opposite to the first end portion, the second piston guide projecting from the second end member and inwardly into the interior of the pipe section, the second piston guide comprising a second annular exterior piston guide surface for guiding the motion of the second piston, and a water flow passageway extending through each of the first and second end members and through each of the first and second guide members.

4. An apparatus according to claim 3 wherein the pipe section comprises first and second interior wall sections, the first piston comprising a first interior annular piston surface portion that is positioned to slide along the first annular exterior piston guide surface, the first piston further comprising a second exterior annular surface portion that is positioned to slide along the first interior wall section of the pipe section, the first piston comprising opposed first and second major piston surfaces spaced from one another by the first interior annular surface portion and second exterior annular surface portion, the first hydraulic chamber being annular and defined at least in part by a portion of the first annular exterior piston guide surface, the first major piston surface, a portion of the first interior wall section, and a portion of the first end member, wherein the first piston applies a valve moving force through the first pusher to the valve from the second major piston surface upon delivery of hydraulic fluid to the first hydraulic fluid chamber;

wherein the second piston comprises a third interior annular piston surface portion that is positioned to slide along the second annular exterior piston guide surface, the second piston further comprising a fourth exterior annular surface portion that is positioned to slide along the second interior wall section of the pipe section, the second piston comprising opposed third and fourth major piston surfaces spaced from one another by the third interior annular surface portion and fourth exterior annular surface portion, the second hydraulic chamber being annular and defined at least in part by a portion of the second annular exterior piston guide surface, the third major piston surface, a portion of the second interior wall section, and a portion of the second end member, the apparatus also comprising a second pusher coupled to the fourth major piston surface and to the valve, wherein the second piston applies a valve moving force through the second pusher to the valve from the fourth major piston surface upon delivery of hydraulic fluid to the second hydraulic fluid chamber.

5. An apparatus according to claim 4 wherein the valve comprises a valve cylinder of a polymer material with an exterior surface that is sized to slide along a portion of the interior of the pipe section, wherein the first pusher comprises a first set of a plurality of spaced apart push rods and the second pusher comprises a second set of a plurality of spaced apart push rods.

6. An apparatus according to claim 5 wherein the valve cylinder comprises first and second valve end portions and a plurality of axially extending bores that extend between the first and second end portions of the valve cylinder, each push rod comprising a stem portion sized for insertion into an associated bore in one of the first and second valve end portions, and a push portion of a cross-sectional dimension that is greater than the cross-sectional dimension of the stem portion, the stem portions having a length such that the end of one stem of one push rod inserted into an associated bore at the first valve end portion engages the end of the stem portion of a push rod inserted into the same bore from the second valve end portion.

7. An apparatus according to claim 1 wherein the interior surface of the pipe section comprises a valve engaging surface portion and wherein the valve comprises a seamless valve cylinder of a polymer material with an exterior surface that is sized to slide along the valve engaging surface portion.

8. A aquifer recharge valve assembly comprising:

a pipe section comprising a wall with an interior surface and an exterior surface;

at least one aperture extending through the wall; and a valve positioned within the interior of the pipe section and movable between a first closed position in which the valve overlies a portion of the interior surface of the wall and the at least one aperture and at least one open position wherein the valve is shifted so as to no longer overlie the at least one aperture at least in part such that aquifer recharge water may flow through the at least one aperture and into the aquifer;

the valve comprising an annular valve body with an exterior surface and a water flow passageway, the valve body having a wall thickness and being comprised of a material that allows the valve body to resiliently expand against the interior surface of the wall in response to water pressure to assist in sealing the at least one aperture when the valve is positioned in the closed position; and a valve actuator for moving the valve between the first closed position and the at least one open position, the valve actuator comprising first and second hydraulic pistons coupled to the valve, a first hydraulic fluid chamber associated with the first piston and a second hydraulic fluid chamber associated with the second piston, one of the first and second pistons being operable to urge the valve toward said first closed position upon delivery of hydraulic fluid to the hydraulic fluid chamber associated with said one of the first and second pistons, the other of the first and second pistons being operable to urge the valve toward the at least one open position upon delivery of hydraulic fluid to the hydraulic fluid chamber associated with the said other of the first and second pistons.

9. An apparatus according to claim 8 wherein the first and second pistons are each annular with respective first and second openings extending therethrough, the apparatus further comprising first and second piston guides coupled to the pipe section, the first piston guide being inserted through the first opening of the first piston and slidably engaging the first piston, and the second piston guide being inserted through the second opening in the second piston and slidably engaging the second piston.

10. An apparatus according to claim 8 wherein there are plural apertures arranged in a spiral pattern about the circumference of the pipe section, wherein the valve is movable to various open positions corresponding to various apertures being no longer being overlaid by the valve to thereby vary the recharge water flow rate through the valve and into the aquifer.

11. An aquifer recharge valve assembly for a well comprising:

an elongated pipe section comprising a wall with an interior surface and an exterior surface;

a plurality of apertures through the wall of an apertured portion of the pipe section, at least some of the apertures being at different locations along the length of the apertured portion of the pipe section;

a valve comprising first and second opposed end portions, the valve being positioned within the pipe section and comprising a cylindrical aperture closing section slidable along the interior surface of the wall between a first closed position and open positions, wherein when in the first closed position the aperture closing section overlies and closes the apertures, wherein when the aperture closing section is in open positions, the aperture closing section does not overlie and close the apertures, the flow rate through the valve being varied by the extent to which the apertures are not overlaid when the valve is in the various open positions, the valve being of a resilient material such that, upon installation of the valve assembly in a well, head pressure of water within the well urges the valve closing section outwardly and against the interior surface of the wall at least when the valve is in the closed position;

at least a first hydraulic piston coupled to the first end portion of the valve and at least a second hydraulic piston coupled to the second end portion of the valve, the first and second pistons also being coupled to the interior surface of the wall of the pipe section and operable to shift the valve between the first closed position and the open positions; and a first hydraulic fluid chamber associated with the first piston and a second hydraulic fluid chamber associated with the second piston, one of the first and second pistons being operable to urge the valve toward said first closed position upon delivery of hydraulic fluid to the hydraulic fluid chamber associated with said one of the first and second pistons, the other of the first and second pistons being operable to urge the valve toward at least one open position upon delivery of hydraulic fluid to the hydraulic fluid chamber associated with the said other of the first and second pistons.

12. An aquifer recharge valve assembly according to claim 11 wherein the first and second pistons are each annular with respective first and second openings extending therethrough, the apparatus further comprising first and second piston guides coupled to the pipe section, the first piston guide being inserted through the first opening of the first piston and slidably engaging the first piston, and the second piston guide being inserted through the second opening in the second piston and slidably engaging the second piston.

13. An apparatus according to claim 11 wherein the pipe section comprises respective first and second end portions, the apparatus comprising first and second end cap members, the first end cap member being coupled to the first end portion of the pipe section, a first piston guide projecting from the first end cap member and inwardly into the interior of the pipe section, the second end cap member being coupled to the second end portion of the pipe section opposite to the first end portion, a second piston guide projecting from the second end cap member and inwardly into the interior of the pipe section, and a water flow passageway extending through each of the first and second end cap members and through each of the first and second piston guides, the first piston guide slidably engaging and guiding the first piston and the second piston guide slidably engaging and guiding the second piston.

14. An apparatus according to claim 13 wherein the wall with the interior surface of the pipe section comprises first and second interior wall sections positioned on opposite sides of the apertured portion of the pipe section from one another, the first piston comprising a first interior annular piston surface portion that is positioned to slide along the first piston guide, the first piston further comprising a second exterior annular surface portion that is positioned to slide along the first interior wall section of the pipe section, the first piston comprising opposed first and second major piston surfaces spaced from one another by the first interior annular surface portion and second exterior annular surface portion, the first hydraulic chamber being annular and defined at least in part by an exterior surface portion of the first piston guide, the first major piston surface, a portion of the first interior wall section, and a portion of the first end cap member, a first set of plural push rods coupled to the second major piston surface and to the valve, the first piston applying a valve moving force through the first set of push rods to the valve from the second major piston surface upon delivery of hydraulic fluid to the first hydraulic fluid chamber;

wherein second piston comprises a third interior annular piston surface that is positioned to slide along the second piston guide, the first piston further comprising a fourth exterior annular surface portion that is positioned to slide along the second interior wall section of the pipe section, the second piston comprising opposed third and fourth major piston surfaces spaced from one another by the respective third interior annular surface portion and fourth exterior annular surface portion, the second hydraulic fluid chamber being annular and defined at least in part by an exterior surface portion of the second piston guide, the third major piston surface, a portion of the second interior wall section, and a portion of the second end cap member, a second set of plural push rods coupled to the fourth major piston surface and to the valve, the piston applying a valve moving force through the second set of push rods to the valve from the second major piston surface upon delivery of hydraulic fluid to the second hydraulic fluid chamber.

15. An apparatus according to claim 14 wherein the valve comprises a valve cylinder of a polymer material having first and second valve end portions, a plurality of axially extending bores extending into the first and second valve end portions, each push rod comprising a stem portion sized for insertion into an associated bore in one of the first and second valve end portions.

16. An aquifer recharge valve assembly according to claim 11 in which the apertures are arranged in a spiral pattern and in which the flow rate increases as the valve is shifted from the closed position to the fully open position.

17. An aquifer recharge valve assembly according to claim 11 comprising a hydraulic circuit through which operating fluid is supplied to and removed from the first and second hydraulic fluid chambers, the valve assembly comprising a visual valve position indicator coupled to the hydraulic circuit and operable to visually indicate the position of the valve within the pipe section at a location remote from the valve.

18. An aquifer recharge valve assembly according to claim 17 in which the valve position indicator comprises a valve position indicating piston and cylinder in the hydraulic circuit, the valve position indicating piston being moved with the valve, whereby the position of the valve position indicating piston corresponds to the position of the valve.

19. An aquifer recharge valve assembly according to claim 18 comprising a movable member coupled to the valve position indicating piston for movement with the valve position indicating piston, the position of the movable member visually indicating the position of the valve position indicating piston and thereby the position of the valve.

20. An aquifer recharge system assembly for a well having a well head at the surface of the well and comprising:

a well pipe extending from the well head and into the well;

a pump comprising at least one water moving impeller in the well pipe and adjacent to the bottom of the well;

a pump motor selectively operable to rotate the at least one water moving impeller to pump water from the well;

a water recharge valve assembly comprising a section of the well pipe, the valve assembly comprising a pipe section having a wall portion with plural water recharge apertures therethrough which are spaced along at least a portion of the length of the wall portion, the wall portion comprising an interior wall surface, the valve assembly comprising a valve, the valve comprising a valve body that includes an aperture closing surface, the valve body being slidable along the interior wall surface between a closed position in which the aperture closing surface blocks the recharge apertures and open positions in which one or more recharge apertures are at least partially opened, the valve body comprising first and second valve end portions and comprising at least one opening through which water can flow between the first and second valve end portions, the valve body having a wall thickness and being comprised of a material that allows the valve body to resiliently expand to urge the aperture closing surface against the interior wall surface in response to water pressure to assist in sealing the apertures when the valve is positioned in the closed position; and at least one hydraulic actuator coupled to valve and operable to slide the valve body between the closed and open positions;

the valve body being shifted to the closed position as water is pumped from the well;

a water recharge pump operable to selectively pump recharge water from a water source and into the well to recharge the well, the valve body being shifted to one or more open positions to recharge the aquifer such that recharge water may flow through the open apertures and into the aquifer;

a check valve in the well pipe and below the valve assembly and selectively operable to hold a column of water in the well pipe prior to delivery of recharge water into the well pipe; and a controller coupled to the at least one hydraulic cylinder and operable to shift the valve body between various open positions at least as recharge water is delivered to the well pipe so as to maintain a positive pressure at the well head.

21. An aquifer recharge system according to claim 20 in which the at least one hydraulic actuator comprises first and second hydraulic pistons coupled to the valve body, a first hydraulic fluid chamber associated with the first piston and a second hydraulic fluid chamber associated with the second piston, one of the first and second pistons being operable to urge the valve body toward said first closed position upon delivery of hydraulic fluid to the hydraulic fluid chamber associated with said one of the first and second pistons, the other of the first and second pistons being operable to urge the valve body toward the at least one open position upon delivery of hydraulic fluid to the hydraulic fluid chamber associated with the said other of the first and second pistons.

22. An aquifer recharge system according to claim 20 in which the valve aperture closing surface is above the at least one water moving impeller.

23. An aquifer recharge system according to claim 20 in which the valve aperture closing surface is below the at least one water moving impeller.

24. An aquifer recharge system according to claim 20 in which the valve aperture closing surface is below the apertures when the valve is in its most open position.

25. An aquifer recharge system according to claim 20 in which the valve aperture closing surface is above the apertures when the valve is in its most open position.

26. An aquifer recharge system according to claim 20 comprising a visual indicator that is coupled to the valve and is operable to provide a visual indication of the position of the valve body at a location remote from the valve body.

27. An aquifer recharge system according to claim 26 wherein the visual indicator comprises a valve position indicating piston in a hydraulic fluid delivery circuit operable to supply hydraulic fluid to the at least one hydraulic actuator, the valve position indicating piston moving with the movement of the valve body such that the position of the valve position indicating piston corresponds to the position of the valve body.

28. An aquifer recharge system according to claim 27 in which the visual indicator comprises a piston position indicator coupled to the valve position indicating piston.

29. An aquifer recharge system according to claim 28 in which the piston position indicator comprises a piston extension coupled to the valve position indicating piston.

30. An aquifer recharge system according to claim 27 comprising a potentiometer coupled to the valve position indicating piston for providing an electrical signal indicative of the position of the valve position indicating piston.

31. An aquifer recharge system comprising:

a pipe section comprising a wall with an interior surface and an exterior surface and plural apertures extending through the wall;

a valve positioned within the interior of the pipe section and movable between a first closed position in which the valve overlies a portion of the interior surface of the wall and the apertures and at least one open position wherein the valve is shifted so as to no longer overlie the apertures at least in part such that aquifer recharge water may flow through the aperture and into the aquifer; and the valve comprising resilient aperture closing means that expands against overlaid apertures at least when the valve is in the closed position to close such overlaid apertures.

* * * * *